United States Patent [19]

Eubank et al.

[11] Patent Number: 4,967,830

[45] Date of Patent: Nov. 6, 1990

[54] ARCUATE TUBULAR EVAPORATOR HEAT EXCHANGER

[75] Inventors: Michael P. Eubank; Mark A. Eubank, both of Longview, Tex.

[73] Assignee: Eubank Manufacturing Enterprises, Inc., Longview, Tex.

[21] Appl. No.: 461,412

[22] Filed: Jan. 5, 1990

Related U.S. Application Data

[63] Continuation-in-part of Ser. No. 189,248, May 2, 1988, abandoned.

[51] Int. Cl.[5] ..... F25B 29/00

[52] U.S. Cl. ..... 165/48.1; 165/125; 62/211; 62/223; 62/515; 62/516

[58] Field of Search ..... 165/48.1, 125; 62/211, 62/223, 515, 516

[56] References Cited

U.S. PATENT DOCUMENTS

| | | | |
|---|---|---|---|
| 1,424,689 | 8/1922 | Stone | 165/48.1 |
| 1,872,785 | 8/1932 | Modine . | |
| 1,893,650 | 1/1933 | Modine . | |
| 1,994,184 | 3/1935 | Williams . | |
| 2,056,041 | 9/1936 | Erbach . | |
| 2,060,589 | 11/1936 | Otto . | |
| 2,159,913 | 5/1939 | Tenney | 165/125 |
| 2,162,152 | 6/1939 | Wulle . | |
| 2,212,748 | 8/1940 | Parker | 165/125 |
| 2,252,064 | 8/1941 | Cornell, Jr. . | |
| 2,260,594 | 10/1941 | Young . | |
| 2,277,247 | 3/1942 | Morse . | |
| 2,346,410 | 4/1944 | Ashley et al. . | |
| 2,454,654 | 11/1948 | Kautman | 165/125 |
| 2,610,484 | 9/1952 | Lange | 165/125 |
| 2,638,757 | 5/1953 | Borgerd . | |
| 2,667,764 | 2/1954 | Turner . | |
| 2,795,938 | 6/1957 | Galazzi | 165/48.1 |
| 2,816,423 | 12/1957 | Brugler | 165/48.1 |
| 2,817,217 | 12/1957 | Winkler et al. | 165/48.1 |
| 3,223,155 | 12/1965 | Hubbard . | |
| 3,267,995 | 8/1966 | Maudlin | 165/48.1 |
| 3,759,321 | 9/1973 | Ares . | |
| 3,803,864 | 4/1974 | Cooper . | |
| 4,182,132 | 1/1980 | Nasser et al. . | |
| 4,311,191 | 1/1982 | VanderVaart . | |
| 4,565,075 | 1/1986 | Drucker et al. | 165/122 |
| 4,615,176 | 10/1986 | Tippmann . | |
| 4,745,767 | 5/1988 | Ohya et al. . | |

FOREIGN PATENT DOCUMENTS

| | | | |
|---|---|---|---|
| 0280327 | 12/1986 | Japan | 165/125 |
| 2085764 | 5/1982 | United Kingdom | 165/125 |

*Primary Examiner*—John Ford

*Attorney, Agent, or Firm*—James C. Fails; Arthur F. Zobal; Geoffrey A. Mantooth

[57] ABSTRACT

An indoor heat exchange unit and method of making same characterized by an arcuate coil shape heat exchange unit made by bending a planar heat exchange unit to fit within a limited space with an open inlet at one end and blocked at the other end so as to force air to flow past the coil and transfer heat through the fins and tubes of the coil in the process. Also disclosed are preferred embodiments in which an air circulation fan circulates air and where a thermostat controls the flow of heat exchange fluid through the coil as the air is passed through the arcuate coil to obtain a predetermined temperature, or the like, in the air.

45 Claims, 14 Drawing Sheets

FIG. 11
PRIOR ART
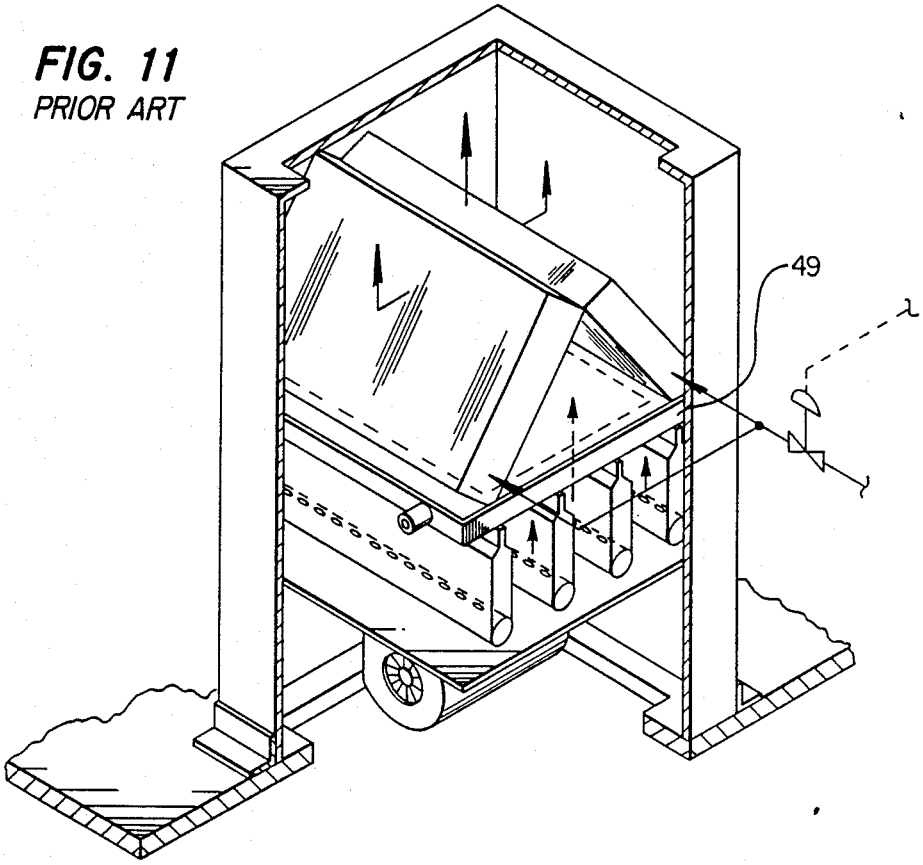
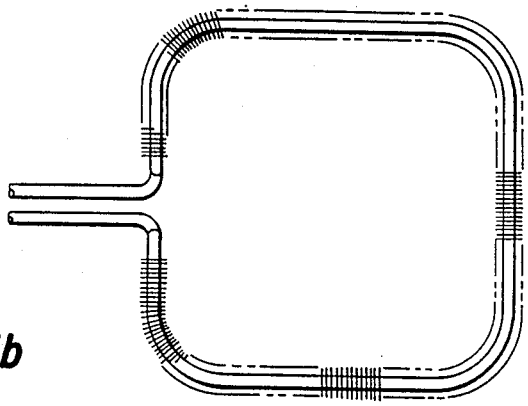
FIG. 5b

FIG. 16a
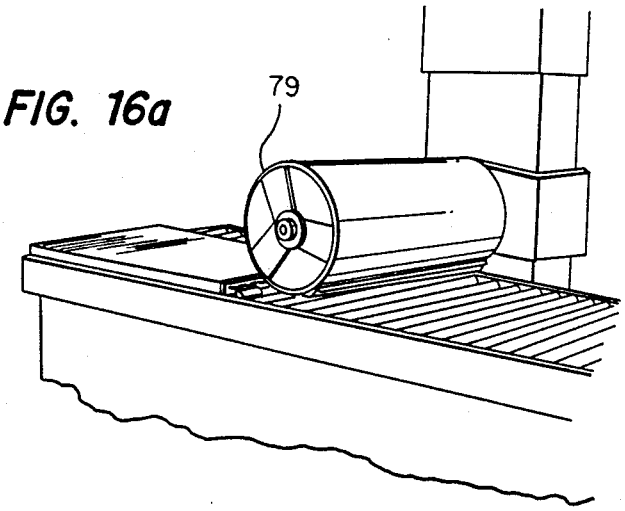
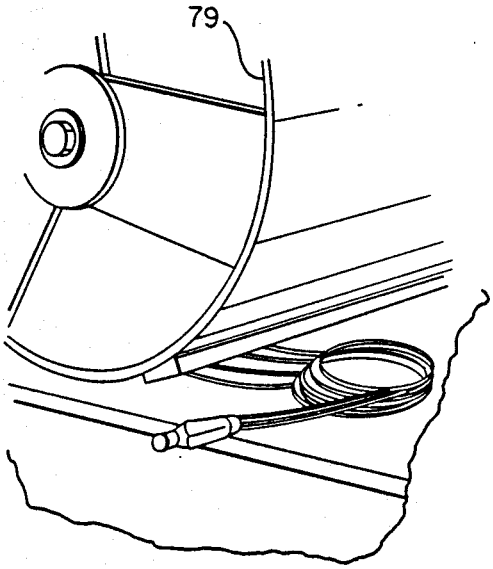
FIG. 16b
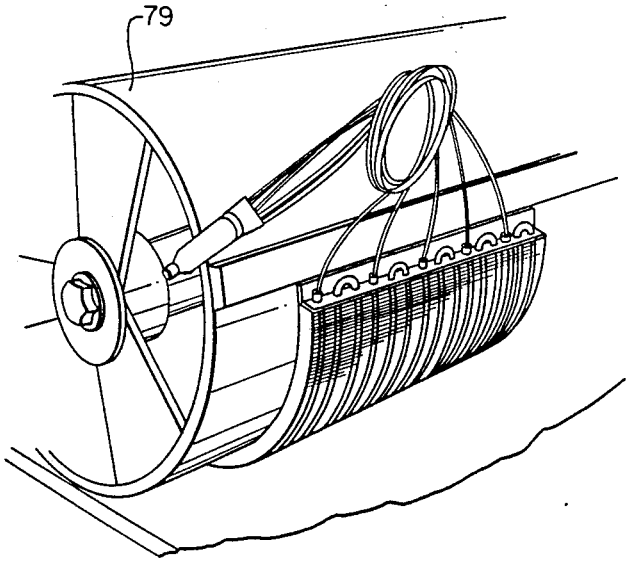
FIG. 16c

ARCUATE TUBULAR EVAPORATOR HEAT EXCHANGER

CROSS REFERENCE TO RELATED APPLICATIONS

This invention is a continuation-in-part application of application Ser. No. 189,248 filed May 2, 1988, and now abandoned.

FIELD OF THE INVENTION

This invention relates to an evaporator apparatus and process for forming an arcuate tubular evaporator heat exchanger for fitting into a limited space and yet having improvement over the prior art. More particularly, this invention relates to method and apparatus for forming an arcuate evaporator heat exchanger for fitting into limited space and for removing heat and dehumidifying to provide an improved air conditioned living space responsive to the heat exchange with a heat exchange fluid.

BACKGROUND OF THE INVENTION

The prior art is replete with a wide variety of different approaches to conditioning air to improve livability within an enclosed space in both the air conditioning, or cooling, mode.

The evaporator configuration of this invention consists of a planar coil bent into an arcuate shape, as by bending about a right angle axis. It will be referred to herein as the "O-coil." The O-coil arrangement was designed to replace the commercially most successful A-type coil in which slab heat exchangers are placed at respective angles with end gables to cause air to flow through the heat exchange coils in an evaporator set up, as for cooling and/or dehumidifying air. It is in this environment that the invention will be described and claimed hereinafter. It is in this comparison that the invention will be more nearly completely understood by referring to FIG. 15 and Table I later hereinafter.

In addition, one of the more pertinent patents found in a prior search, and described in the inclosed 37 CFR 1.56(a) Information Disclosure Statement, accompanying this application, U.S. Pat. No. 1,994,184 to Williams which describes a warm air heating system that is adaptable for use with a fuel burner and can be employed to provide distribution means for distributing hot water for domestic purposes In addition, the invention describes a method of cooling the atmosphere of rooms by circulating refrigerated water through a coil of pipes installed into the main trunk of an air duct system. While this invention could not be employed in applicant's invention, it is pertinent in showing a central distribution system for distributing air cooled by refrigerated water circulated through the coil of pipes installed into the main trunk of air duct system and remote from and dependent on a separate blower for airflow. However, the invention does not anticipate reducing the temperature of the coil of pipes down to dew point made obvious by the absence of condensate collection means for the collection and removal of condensate or humidity.

A consideration of the total prior art shows that none of the prior art could be employed in applicant's invention and that the prior art does not anticipate or make obvious applicant's invention. In particular, the prior art tends to employ fans for moving air in which the fans are located as a part of the evaporator so that higher differential pressures can be employed. Moreover, most of the prior art was employed for merely local, or spot, cooling and could not be employed in a central distribution system, particularly where a duct system was employed in having a blower elsewhere, or remote from the O-coil of this invention.

It is desirable that the invention have the following features not provided heretofore.

1. The invention should not include an air mover as a part of the design, since if a fan is employed, a simple change of direction such as changing the angle to increase the pitch for more air flow, changes the direction of the air flow.

2. It is important that the invention be compatible in retrofit, or new construction situations with any available residential or light commercial air handler or furnace regardless of direction of air flow and either upstream or downstream of the air mover.

3. It is advantageous that the invention be installable in a retrofit situation even in small spaces without requiring removing any door or requiring any doorway disassembly.

4. It is beneficial that the invention include the housing as an integral part of the assembly. Not only does the dimension of the housing affect the coil performance, it must mate with the openings of conventional systems such as a retrofit installation, in a ducted system, opening of furnaces or the like and be adapted to handle the air volume of either light commercial or residential application, yet assure that the effort to install the coil and the housing is no greater than would be encountered when installing a conventional indoor coil assembly.

5. It is important that the invention achieve a designed air distribution with critical volume ratios with respect to volume of the coil and the volume of the housing. Where the heights of the coil and housing are equal, the critical volume ratios become critical area ratios. The coil housing not only serves as an enclosure to insulate and direct the conditioned air in accordance with entering effluent air circulated within a distribution duct, it also serves to direct the air through the coil surface by controlling resistance effected by the air flow. In the conventional installation, the pressure across the coil may be high enough to effect a distribution of the air flow according to a desired plan. In this invention, however, which uses only a primary coil, or single tube row in most instances or at most a portion of an additional tube row, the pressure drop is so low that means to affect the air flow is frequently employed to assist in achieving the desired air distribution of flow. In one instance, the item affecting flow of air is the critical ratio of the cross-sectional area of the housing, to the cross-sectional area of the coil.

6. It is desirable that this invention be efficient in transferring heat; for example, it can employ a high efficiency tubing such as rifled tubing and enhanced plate fins to achieve heat transfer higher than possible heretofore in order to achieve the heat transfer per unit of space occupied.

7. This invention will make cost savings possible and achieve ready commercial acceptance. To do this, the O-coil configuration of this invention achieves a labor savings in excess of 30 percent. It enables, making a single installation of inlet and outlet headers with a pressure test before being bent into arcuate configuration, rather than requiring two separate tests. Additional features include:

a. when compared to its closest commercially viable design, that is the multi-row A-coil, the present invention requires only a single coil manufacture whereas the A-coil requires two;

b. this O-coil configuration is referred to as an O-coil and it eliminates the triangular delta plates that must be installed on both ends of an A-coil;

c. the O-coil has less weld joints per unit when compared to the A-coil and is adapted for either up flow or down flow of the air to achieve high efficiency heat transfer;

d. the A-coil slabs, which consist of two separate coil assemblies, must be manifolded together whereas the O-coil is one complete coil and is manufactured in a single operation without requiring manifolding together the separate slabs or the like; and e. finally, the A-coil slabs must be manually assembled and fastened into one assembly; whereas the O-coil is inherently a single assembly that is mechanically formed into an assembly and can be installed readily.

From the foregoing it can be seen that this invention provides improvements not seen in the prior art. For example, when compared with the A-coil, the O-coil manufacture increases the face area by more than about 40 percent for a given volume so that it employs less copper in the heat exchanger; requires less horse power to flow air through the heat exchanger; requires less material; eliminates weight; reduces the number of U-bends and refrigerant crossover tubing, reducing soldering leak possibilities, as well as reducing work in assembly.

By doing this with the higher performance coil designs available today, the unit is designed to serve as direct replacement for the conventional A-coil units at approximately 70 per cent of the cost. Laboratory testing performed to demonstrate the feasibility of this invention have demonstrated this to be the case.

These features have not been satisfactorily provided by the prior art heretofore.

SUMMARY OF THE INVENTION

Accordingly, it is an object of this invention to provide method and apparatus that effects one or more of the features delineated hereinbefore and not heretofore provided.

It is an object of this invention to provide method and apparatus that effects substantially all of the features delineated herebefore and not heretofore provided.

These and other objects will become apparent from the descriptive matter hereinafter, particularly when taken in conjunction with the appended drawings.

In one embodiment of this invention, there is provided an indoor evaporator assembly bent from a planar unit into an arcuate coil so as to fit within a limited space, having an open inlet passageway at one inlet end and blocked at the other end to force air to flow radially through the coil of fins and tubes during operation.

In accordance with one embodiment of this invention, there is provided an improved compact air cooling and dehumidifying assembly adapted for use in an indoor air conditioning system comprising an air duct system having a central trunk and multiple branch ducts, a furnace or air handler including a blower for moving room air through the duct system, a plenum chamber or coil enclosure which may be part of the furnace or air handler cabinet in the axial air flow direction either upflow or downflow forming at least part of the central trunk of the duct system, and being in series flow relationship with the blower, and upstream of the multiple ducts, an evaporator assembly in the plenum chamber, or coil enclosure, and an air conditioner pump and condenser physically distinct from and separated from the evaporator assembly and connected thereto by refrigerant conduits; the improvement comprising the evaporator assembly having an evaporator coil of arcuate shape formed by bending about a central axis a fin and tube heat exchanger core of a planar shape having no more than two tube rows, the evaporator assembly furthermore having an air directing means located at one end of the evaporator coil with the air directing means having a central opening permitting the passage of room air along the central axis to or from the interior of the evaporator coil, the air directing means cooperating with the plenum chamber to assure that all the air passing through the plenum chamber passes through the interior of the evaporator coil and an air deflector means at the other end of the evaporator coil for converting the flow of the air to radial components for passage through the arcuate shaped evaporator coil and into the plenum chamber.

In preferred embodiments, this O-coil configuration has low pressure drop across the evaporator assembly of less than three-tenths inch of water (0.3" H2O) and includes means for affecting flow of air through the coil. It also includes a drip pan assembly for condensate runoff and is in a form that can be readily retrofit into existing duct systems. It satisfies all the heat transfer efficiency requirements of the regulatory agencies, including the Department of Energy with its reliance upon ARI (Air Conditioning and Refrigeration Institute) Standard 210, American Society of Heating and Refrigeration Air Conditioning Engineers (ASHRAE), and local, state and federal standards, as well as satisfying the pressure testing requirements of Underwriters Laboratory. It effects a major portion of the heat transfer in a single primary coil with a recognized high efficiency attendant to such primary heat transfer Moreover, this is done regardless of direction of air flow through the plenum section in which the heat exchange unit is installed. In another embodiment, there is provided a method of forming the arcuate evaporator coil by making a planar heat exchange unit and bending into the desired arcuate shape.

Also, the invention provides respective air and heat exchange fluid circuits connected serially with the evaporator coil; and discloses preferred and optional modes of use.

BRIEF DESCRIPTION OF THE DRAWINGS

FIG. 3*b* is a front elevational view of a fin section similar to that illustrated in FIG. 3*a* illustrating a width of the fin and aperture for receiving a tubing section or the like.

FIG. 5*b* illustrates an oval embodiment inclusive of a rectangular shape with rounded corners.

FIG. 11 is a schematic illustration of a suitable upflow housing and coil used for a plurality of duct plenums, in a prior art A-coil version employing a heater or furnace as an air handler.

DESCRIPTION OF PREFERRED EMBODIMENTS

This invention has a plurality of aspects, as will become apparent from the descriptive matter hereinafter. These aspects may be employed alone or with one another or in con]unction with other approaches for conditioning the air. By conditioning the air is meant controlling the temperature and/or humidity of the air to improve the comfort index of air being circulated within an enclosed space, as in a home, commercial building or the like.

Accordingly, this invention will be described hereinafter with respect to these aspects, it being realized that these aspects can be combined with each other or other adjuncts as desired.

The term "air conditioner" as used herein refers to a central air conditioner in the normal sense. The terms "evaporator" or "evaporator coil" as used herein refer to an air conditioner heat exchange coil located within a building for removing heat and humidity from the building internal air. The term "evaporator assembly" used herein refers to the heat exchange coil and components necessary for proper operation; such as a condensate pan for the collection of moisture to be removed from the conditioned area by means of a drain pipe and which serves as an air inlet and air directing means; an air deflector which serves as an air directing means; and a coil enclosure which is installed about the evaporator coil and forms part of the central trunk of a central duct system, such as an inlet air plenum or outlet air plenum.

Figure 1:
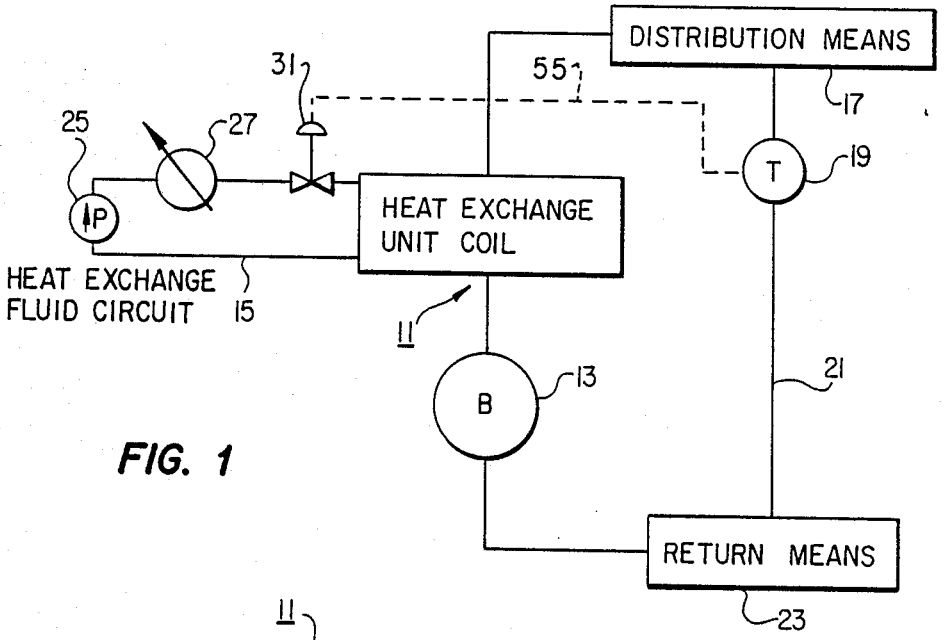
FIG. 1 is a schematic block flow diagram showing one embodiment of this invention.

Referring to FIG. 1, there is illustrated the indoor evaporator coil 11 which is the subject of this invention, disposed serially in two circuits. The first circuit is an air circulation circuit in which air is circulated by an air handler, frequently called a blower B, also given the number 13, through evaporator coil 11 in heat exchange relationship with fins and tubes in a conventional arrangement. As will become clearer from the descriptive matter later hereinafter, a heat exchange fluid, such as Freon, is flowed in a second heat exchange fluid circuit 15 and in heat exchange relationship with the air.

In accordance with the usual set up, the first circuit in which the air is circulated consists of a distribution means 17, a thermostat 19 for monitoring the temperature, humidity or the like in the air circulation circuit and, in turn, controls the flow of the heat exchange fluid, as by opening an expansion device 31, starting or stopping a compressor 25, or the like. The expansion device is controlled by the control line 55, as from a thermostat or the like. Such a control line may be electrical if an electrical thermostat is used. On the other hand, it may be pneumatic if a pneumatic control is employed. The air is then distributed to the various rooms and through ducts 21 or the like and returned via a return means 23. The distribution means 17 may be the conventional insulated metallic plenum or the like. Similarly, the return means 23 may comprise duct work or may be simply the open interior space of the enclosed space, as along the hallway of a home or the like. Typically the return means 23 is part of a furnace or air handler and may comprise an inlet plenum containing an evaporator coil 11. The coil 11 could be located upstream or downstream from blower and downstream from return means 23.

The indoor evaporator coil 11 will be described in more detail with respect to later figures.

The blower 13 may comprise a conventional air mover in the form of squirrel cage blower, centrifugal blower, or whatever is appropriate to the design of the system, and typically part of a furnace or air handler system. One of the advantages of this invention is that the pressure drop across the evaporator coil is so low that secondary blowers are not required.

The heat exchange fluid circuit will comprise a pump or compressor 25 for moving the heat exchange fluid through the circuit and the heat exchange fluid will be moved through an appropriate external heat exchanger 27, an outdoor air conditioner condenser in most instances, and through the evaporator assembly coil 11 of this invention.

The pump or compressor 25 may comprise a compressor for compressing Freon or the like if desired.

The heat exchanger 27 is appropriate for the design of the heat exchanger fluid circuit. For example, where the pump 25 is a compressor the heat exchanger 27 is a condenser for condensing liquid, such as a refrigerant, in which case the liquid may be fed through an expansion device, for flashing in an evaporator assembly 11 as where a refrigerant heat exchange fluid is in liquid form and absorbs heat to become a gaseous state fluid. Ordinarily, as indicated by the direction of flow in FIG. 1, a condensed liquid from the condenser 27 is sent into the evaporator assembly 11 through an expansion device 31, and the cool vapors from the evaporator assembly 11 are returned to the suction side of the compressor or pump 25. The expansion device 31 can be any of the conventionally employed restrictors or expansion devices to allow the liquid at high pressure to become a gas at a low pressure. A wide variety of these approaches will be apparent when FIGS. 7–11 are discussed.

Figure 2:
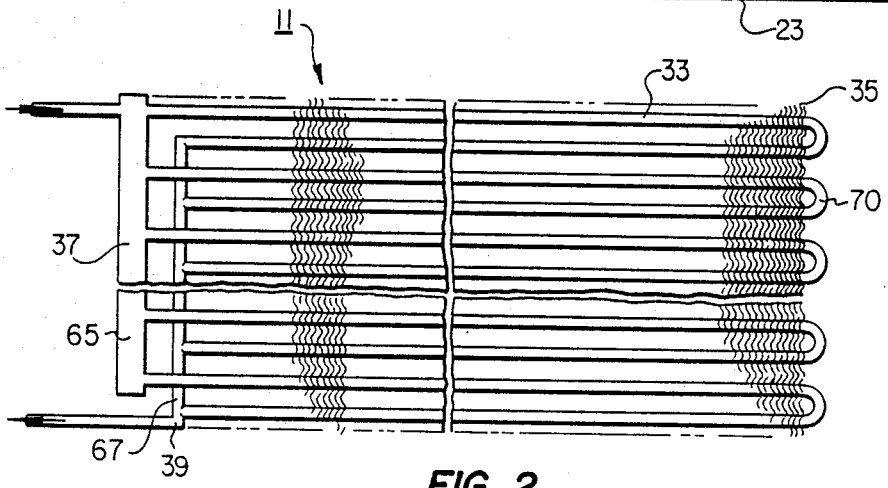
FIG. 2 is a somewhat schematic illustration of a beginning evaporator coil in accordance with one embodiment of this invention; namely, an illustration of a planar heat exchanger having fins and tubes.

Referring to FIG. 2, there is illustrated a somewhat schematic illustration of a beginning apparatus in the form of a planar heat exchanger having enhanced, high efficiency heat transfer coils and fins. Therein, the coils are preferably formed by a plurality of tubes such as high efficiency rifled copper tubes 33, that have respective enhanced fins 35 emplaced thereon to augment the exchange of heat between the heat exchange fluid and the air.

It is noteworthy that in FIG. 2, the inlet and effluent manifolding for the refrigerant are both on the same end and only U-tube bends are at the opposite ends such that the evaporator coil can be bent into a unitary coil configuration and advantageously have the fittings at one end only.

A wide variety of approaches in terms of respective passes of air and exchange fluid are practical and have been employed in the prior art. These range from full concurrent flow to full countercurrent flow to a variety of approaches therebetween. As illustrated, there may be an inlet header 37 and an outlet header 39 with a plurality of tubes 33 connecting therebetween for flowing in parallel flow paths the refrigerant or heat exchange fluid.

Figure 3A:
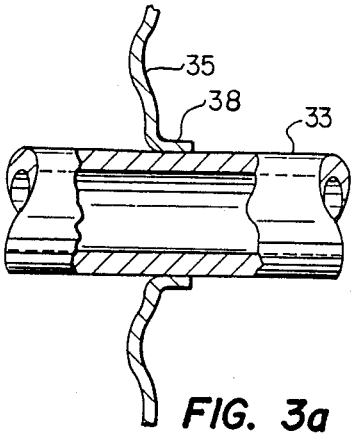
FIG. 3*a* is a partial cross-sectional view of the interconnection between a fin and a tubing section in order to effect heat transfer efficiently.

As can be seen in FIG. 3*a*, each respective tube 33 may have, the fin 35 emplaced thereover by a suitable collar 38 that can be pressed into intimate contact with the exterior surface of the tube 33 to help the heat be conducted away from the tube and the fluid therewithin. This invention can employ other conventional methods of affixing of the fins, such as expansion of the tubing, to get the necessary intimate contact for conducting the heat between the air and the refrigerant fluid, as desired.

Figure 3B:
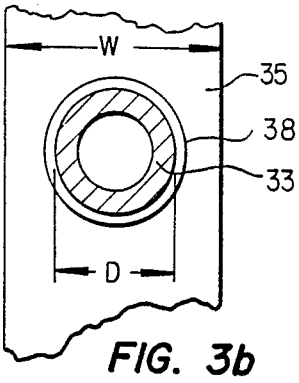

As illustrated in FIG. 3*b*, in the single row configuration, the fin may have a width W which may range from as low as ⅝ inch to as much as 1 ½ inches in this invention. The diameter of the apertures through which the tubes are fitted will be commensurate with the outside diameter of the tubes such that the collars 38 and the wall of the tubes 33 are in intimate contact.

The fins 35 are preferably crimped, corrugated, or otherwise shaped so as to always leave an aperture, or passageway for the flow of air even when the coil is bent to fit within a limited space. Preferably, the number of fins per inch on the tubes may range from as low as 10 to as high as 22 fins per inch. Other numbers of fins can be employed as desired, although these have been found to be the most useful. Ordinarily, it is beneficial to use as may fins as possible without adversely increasing the pressure drop of air flow through the coil to an intolerably high value.

In this respect, preferably, this invention will have a pressure drop through the evaporator assembly of not more than 0.3" water, even when the coil is bent into the arcuate shape to fit within the limited space.

Figure 7:
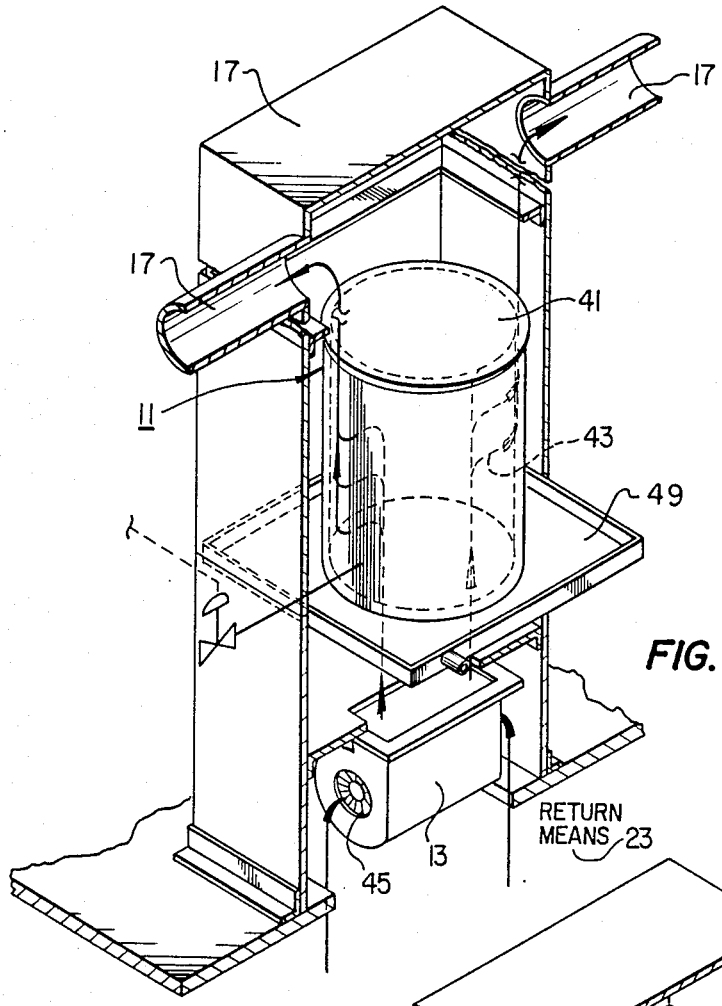
FIG. 7 is a schematic illustration of a typical upflow application of air in a system employing one embodiment of this invention.

As can be seen in FIG. 7, the evaporator coil 11 will have been bent into a right circular form to form a tubular evaporator coil that has one end open, as at the bottom for inlet flow of air.

An air directing means, such as condensate drain pan 49, serves to direct the air longitudinally of the evaporator coil 11. It also serves to drain off condensate as will become clearer hereinafter.

A block, or air deflector means, such as top 41, is emplaced to block the flow of air through the center of the heat exchange unit coil 11, forcing the air to flow radially through the evaporator coil 11, for heat exchange relationship with the heat exchange fluid being flowed through the circuit as described hereinbefore.

Figure 4:
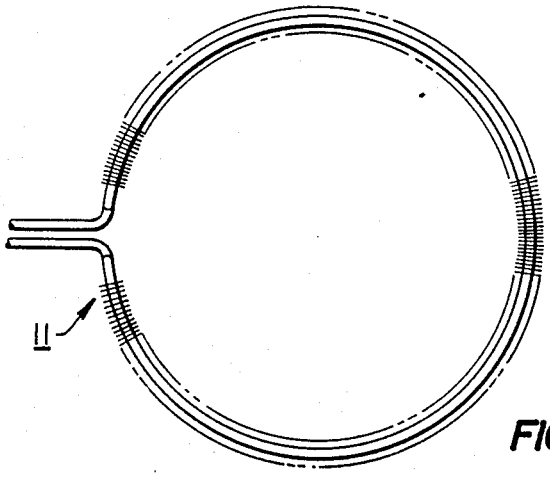
FIG. 4 illustrates one embodiment of this invention in which the evaporator coil is in the form of a circle so the unit forms a right circular cylinder.
Figure 5A:
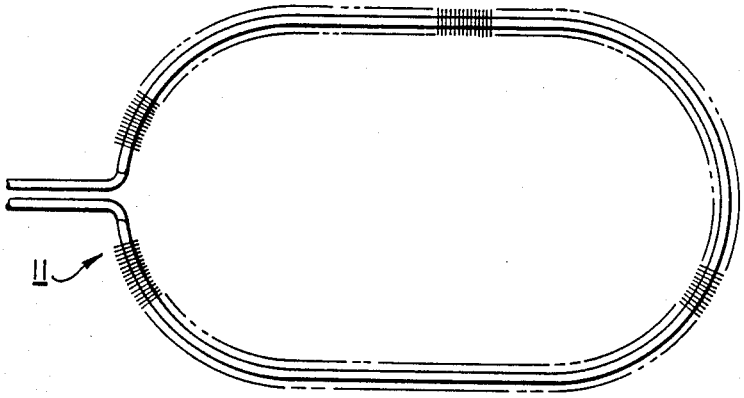
FIG. 5*a* illustrates another embodiment of this invention where the evaporator coil is in the form of an oval.

Referring to FIG. 5*a*, the heat exchanger coil 11 may also be bent into an oval shape to fit in a desired limited space. As illustrated in FIG. 5*b*, the oval shaped heat exchanger unit coil is inclusive of a rectangularly shaped tubular coil with rounded corners. Referring to FIG. 4, the evaporator coil 11 in the preferred form is of circular cross section so as to form a right circular cylinder.

Figure 6:
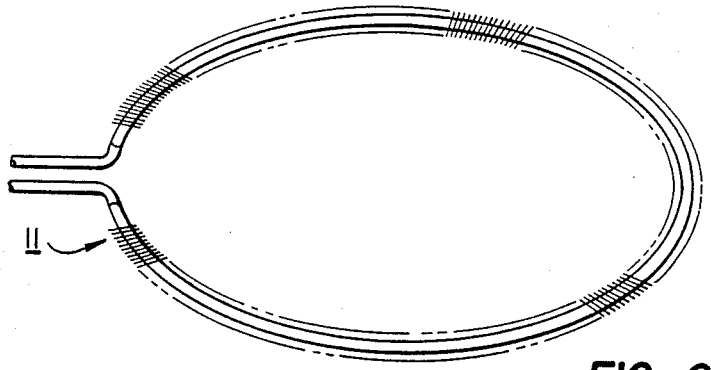
FIG. 6 illustrates still another form of this invention where the evaporator coil is in the form of an ellipse.

Referring to FIG. 6, the heat exchanger coil 11 may be bent into an elliptical shape to fit into a limited space.

FIG. 7 is a schematic illustration of a typical upflow application in which the air is flowed upwardly and outwardly through the evaporator assembly as illustrated by the arrows 43. In this embodiment, or application, air mover 13 may be in the form of a squirrel cage blower that takes suction through an inlet aperture 45 and it may be in series with a furnace or other heat adder.

It is readily known that a heat exchange fluid may be a refrigerant like polyhalogenated hydrocarbon. Typical are the FREONS, such as FREON 12 or FREON 22. The latter is believed to be a diclorodifluoromethane type refrigerant. Other polyhalogenated hydrocarbons like mono- or polychlorinated and mono- or polyflourinated hydrocarbons such as ethane may be employed as the refrigerant and have acceptable pressures and temperatures for cooling in the respective evaporator coils. Other refrigerants may be developed. These other refrigerants could be employed herein. This is primarily because the polyhalogenated hydrocarbons have obtained a bad reputation as destroying the ozone layer and have lent impetus to developing new refrigerants. Such new refrigerants can be employed herein. In the illustrated embodiment of FIG. 7, the distribution means 17 is in the form of air ducts that may go through the ceiling or the like of the enclosure. The air return means may be formed by any of the conventional approaches in this art.

As will be appreciated, the air flows upwardly through the interior of the coil 11 and then outwardly through the evaporator coil in heat exchange relationship with the heat exchange fluid flowing through the heat exchange circuit 15. The air thus flows upwardly through the inner annular space about the coil 11. The coil cap or deflector 41 causes this radial flow of the air which in this direction is radially outwardly as shown by arrows 43.

Figure 8:
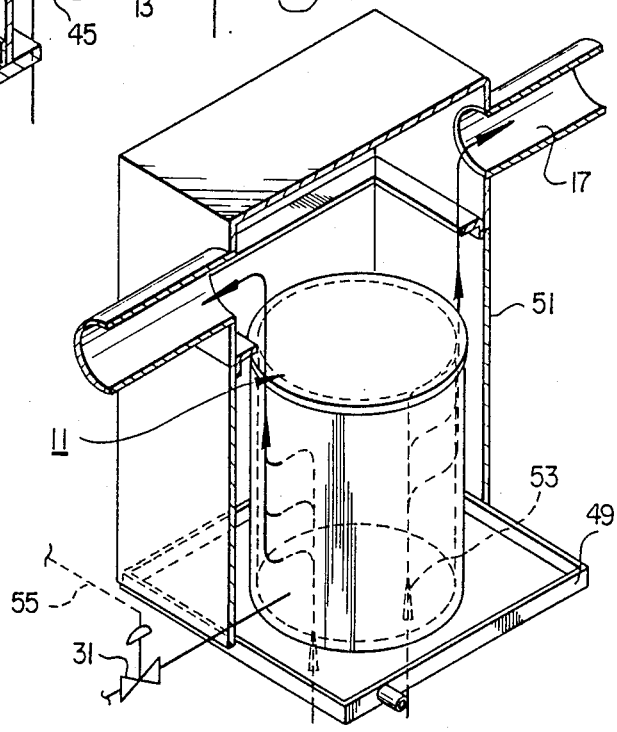
FIG. 8 is a schematic illustration of another embodiment of this invention illustrating a close up view of the embodiment of FIG. 7.

Referring to FIG. 8, the distribution means 17 is in the form of a conventional duct plenum. The coil cap, or deflector 41, forces the air to flow radially outwardly. The coil is employed as an evaporator coil so a condensate pan 49 is employed to collect liquid which will condense on the fins and tubes and drain downwardly into the condensate pan 49. A coil enclosure 51 in the form of conventional metallic ducting, or the like, is employed about the coil 11. The direction of air is in an upflow configuration, as shown by the arrowheads 53, although the direction of airflow is not critical, as will be seen with respect to FIGS. 9 and 10 hereinafter described. Again the deflector 41 causes the air to flow radially outwardly through the coil in this arrangement.

Any suitable return means can be employed in accordance with the usual practice. The evaporator coil can be employed in series with a furnace or other means for adding heat, in series with a thermostat for measuring the temperature of the air and controlling the flow of heat exchange fluid, as illustrated by the dashed control line 55 to the valve 31 for controlling the flow of heat exchange fluid through the evaporator coil 11.

Figure 9:
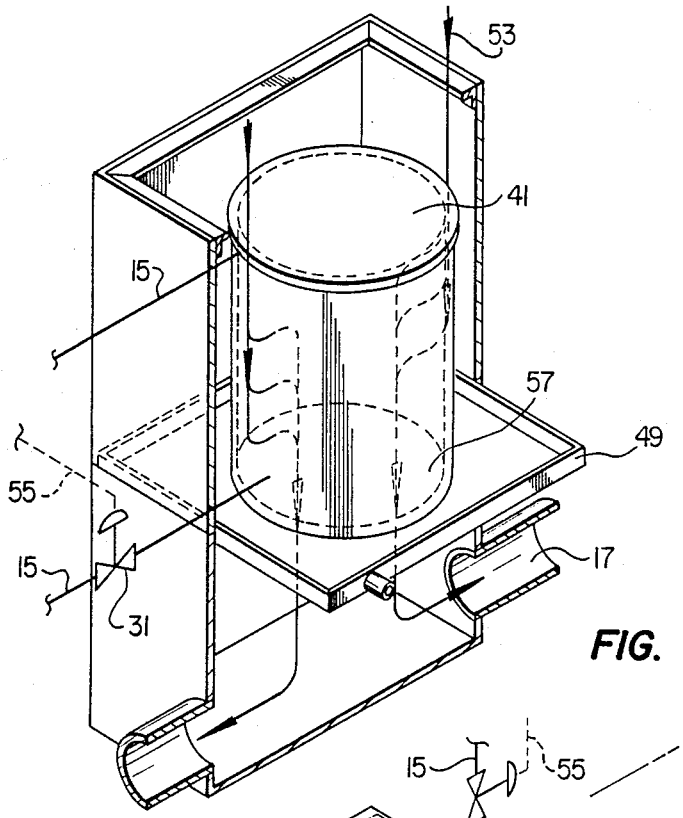
FIG. 9 is a schematic illustration of a downflow configuration of an embodiment of this invention.

Referring to FIG. 9, the distribution means 17 is in the form of a conventional duct plenum along the floor of a mobile home, residence, or the like. A condensate pan 49 is employed. There is an open outlet 57. The deflector 41 still blocks the flow of air; however, the direction of the air flow is downwardly, as shown by the arrowheads 53. In this case, however, the air flows radially inwardly through the evaporator coil 11. Since a condensate pan is illustrated, it will be described with respect to an expansion device 31 in a refrigerant circuit, or heat exchanger fluid circuit 15. In the illustrated embodiment of FIG. 9, the air directing means 57 is actually an outlet where the cooled air exits.

Figure 10:
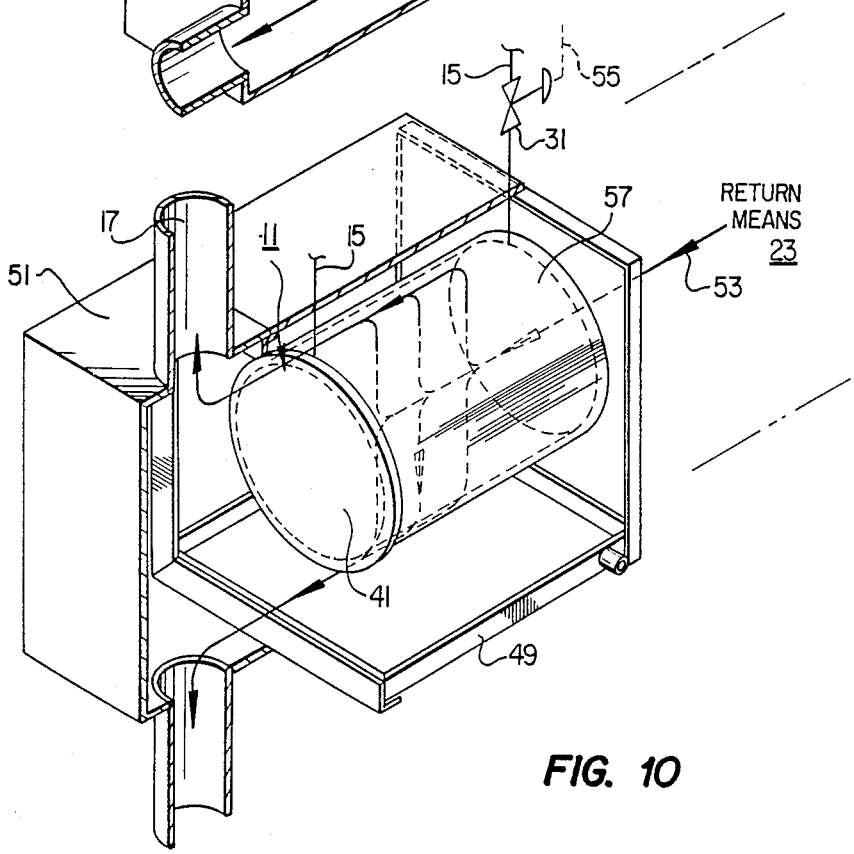
FIG. 10 is a schematic illustration of another embodiment in which there is a horizontal configuration.

FIG. 10 shows a horizontal approach in which the air flow comes from conventional return means 23 and the air flow into an inlet or air directing means, 57. A deflector 41, blocks the flow of the air and causes it to flow radially outwardly as shown by arrow heads 53 to the annular space and thence interiorly of the coil enclosure 51. The coil 11 is an evaporator coil with Freon being fed through an expansion device 31 in the heat exchange fluid circuit 15. As indicated hereinbefore, the expansion device 31 may control the flow of the heat exchange fluid responsive to the thermostat or the like. As illustrated a condensate pan for collecting moisture is shown, the condensate pan being given the number 49.

As will be appreciated, the condensate pans are normally connected to suitable drain for the liquid. This may be a sewer or the like. On the other hand, some condensate pans are vented outside to flowerbeds or the like. In any event, the condensate will always be transferred out of the indoor conditioner area.

Referring to FIG. 11, a typical prior art A-coil evaporator arrangement is shown. A condensate pan 49 is also illustrated to indicate that the A-coil is being employed as an evaporator coil. The present invention improves on this prior art arrangement.

Figure 12A:
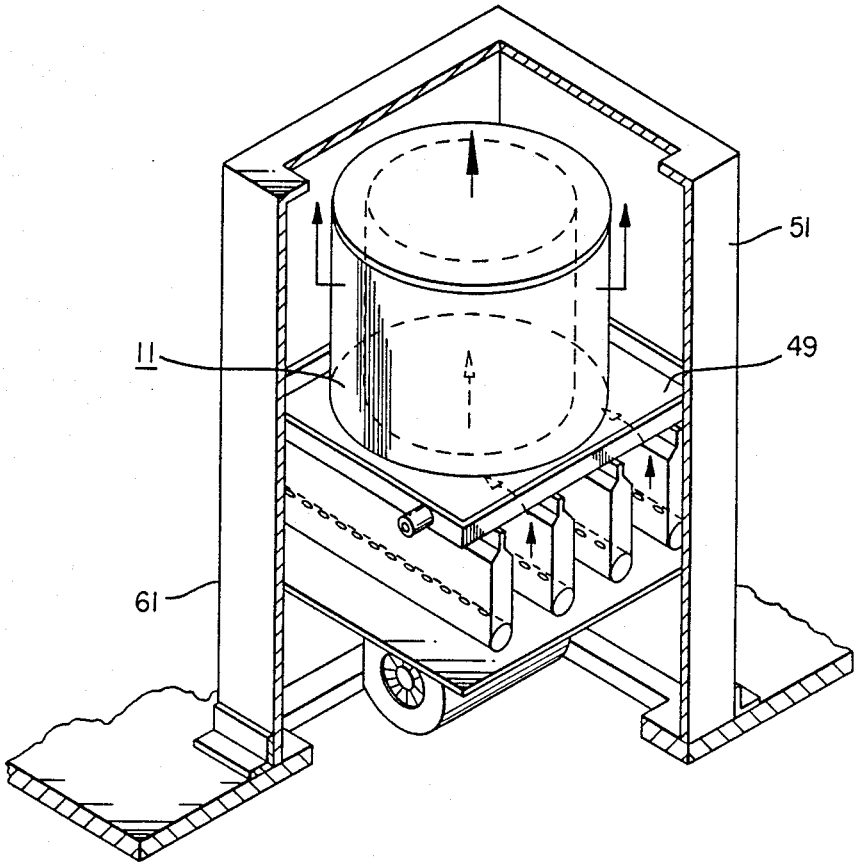
FIG. 12*a* is a schematic isometric view of a section in accordance with a retrofit embodiment of this invention, also employing a heater or furnace as an air handler and forms a preferred embodiment.

Referring to FIG. 12*a*, the indoor O-coil evaporator 11 of the present invention is illustrated in place atop a heater or furnace 61. This is the configuration in which the apparatus of this invention will be employed in many instances. As can be seen in FIG. 12*a*, the heat exchanger is being employed as an evaporator assembly, or air cooling and dehumidifying coil assembly, and a condensate pan 49 is employed to collect water which is removed from the air by the air passing through the evaporator coil 11.

Figure 12B:
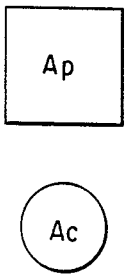
FIG. 12*b* is a schematic illustration of respective critical areas of a rectangular, or square, shaped plenum Ap, and circular coil Ac.

Since, ordinarily, the evaporator coil 11 will employ only a single row of tubing and fins and the pressure drop thereacross is so low, it is preferred that the coil enclosure have a critical ratio of its volume to the volume of the coil. If the height of the coil enclosure and the coil are the same, respective volumes equate to areas. These areas can be seen in FIG. 12*b* in which Ap is the area of a cross-section of a quadrilateral, such as a square or rectangular coil enclosure employing a plurality of 90 degree angles. In the critical ratio areas, Ap must be at least 1.35 Ac when a square or rectangular coil enclosure is employed, where Ap is the area of the coil enclosure and Ac is the circular area of the coil, areas being cross-sectional areas.

Figure 12C:
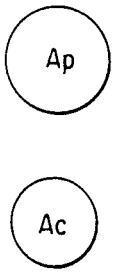
FIG. 12*c* is a schematic illustration of respective critical areas of a circular shaped plenum Ap, and coil Ac.

As illustrated in FIG. 12*c*, however, when a circular plenum or coil enclosure section delineated as Ap is employed, it is only at least 1.2 times the area of the coil Ac.

In the indicated embodiment, the direction of air flow is upwardly through the center of the coil and outwardly radially and upwardly through the coil enclosure section in a conventional upflow system. It is readily apparent, however, that the direction of the air could be reversed if desired.

Figure 13:
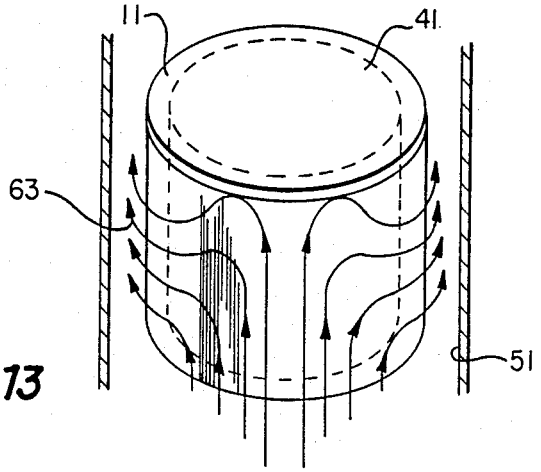
FIG. 13 is an isometric view that shows a direction of airflow through a coil and along the sides of a coil interiorly of a coil enclosure in accordance with an upflow embodiment of this invention, the coil enclosure being shown by straight lines.

The direction of airflow can be understood more nearly completely by referring to FIG. 13. Therein, the deflector 41, blocks the flow of air longitudinally through the interior of the cylindrical coil 11 and causes the air to flow radially outwardly through the coil, as can be seen by the lines 63. Thus, if the area of the housing is great enough, air can flow through the coil as illustrated and obtain a substantially uniform heat flow because of the construction of the planar coil before it is bent into the arcuate configuration. However, if the area of the coil enclosure when compared to the area of the O-coil is reduced below the ratios mentioned above, radial air flow through the coil is hampered, increasing the pressure drop across the coil and causing an uneven distribution of airflow across the various tubes forming the coil 11. The coil enclosure sides designated 51 in FIG. 13 are shown as straight lines.

Figure 14:
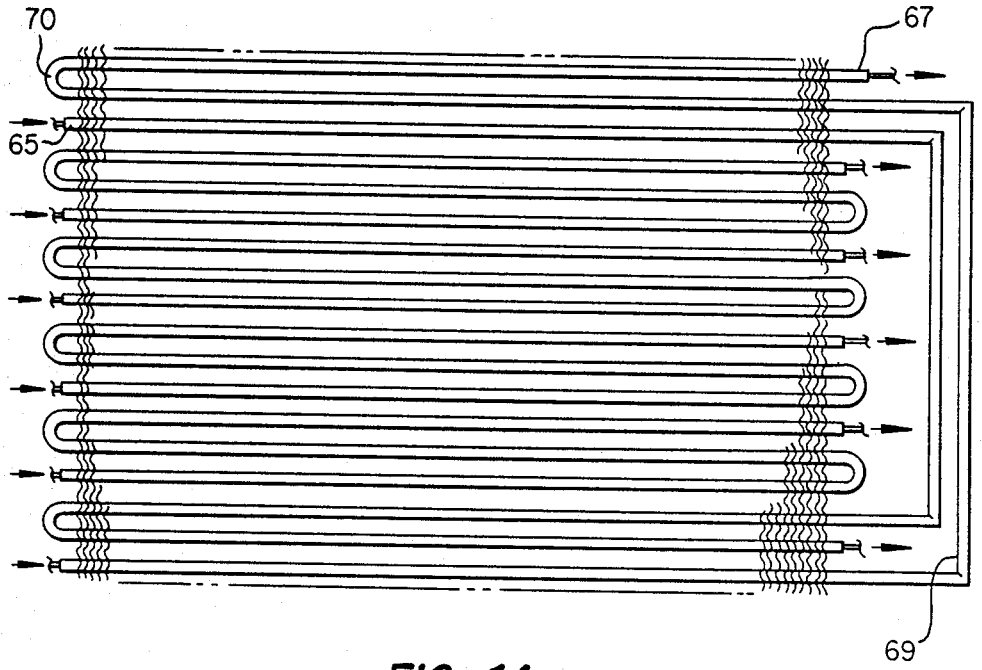
FIG. 14 is a schematic view of a planar coil form before bending into shape and showing a flow pattern of tubing for entering refrigerant, as well as leaving refrigerant.
Figure 18A:
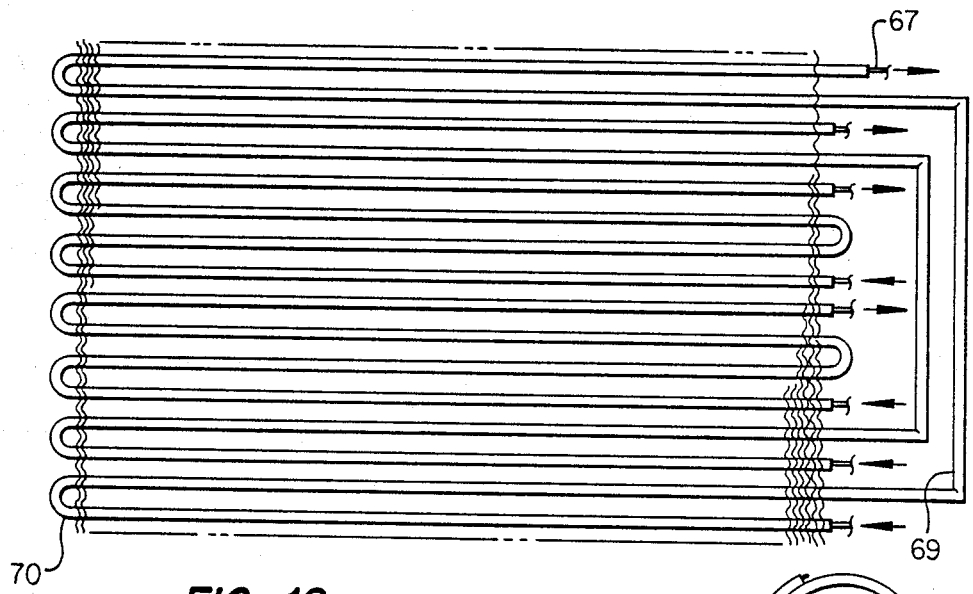
FIG. 18*a* is a circulating coil design for scroll configuration of an O-coil viewed in flat before forming into an overlapping scroll.

The planar coil construction can be seen in FIGS. 2, 14, and 18*a*. Therein, the entering refrigerant is illustrated by the arrows 65 and flows through respective highly efficient copper tubing with the fins surrounding the copper tubing as described hereinbefore. There are shown the effluent, or leaving refrigerant arrows 67 with interchange tubing 69. As will be apparent to one of skill in this art, the interchange tubing effects a more nearly uniform heat transfer regardless of the direction or flow of the air through the coil enclosure 51, FIG. 12*a*. In the preferred embodiment, the fittings, both inlet and outlet fittings 65 and 67, are on the same end and the return bends, or U-bends, 70 are on the other end, as illustrated in FIGS. 2 and 18*a*.

Figure 15:
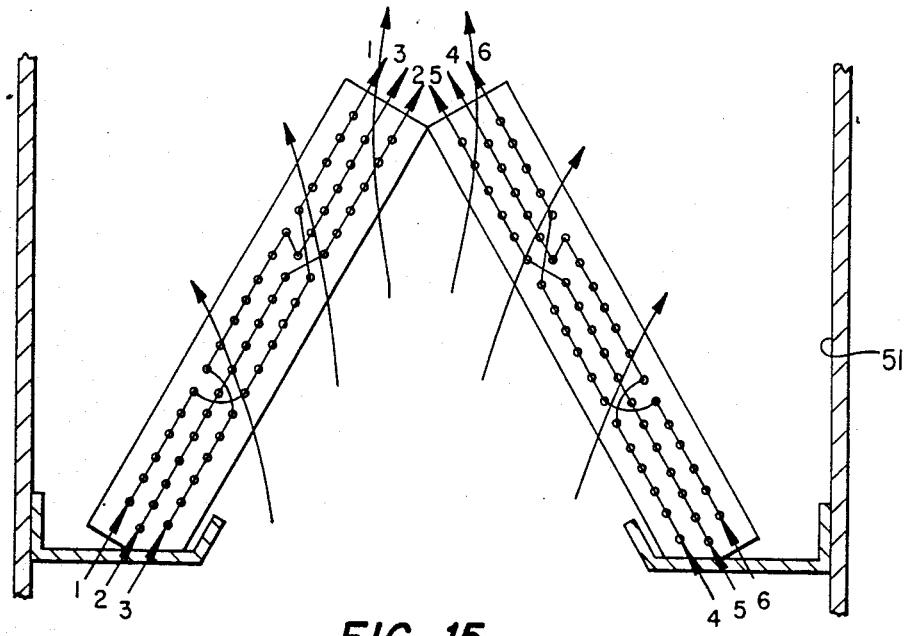
FIG. 15 PRIOR ART
FIG. 15 is an illustration of a typical flow pattern of an A-Coil employing six rows of tubing between two coil slabs, in accordance with the prior art.

FIG. 15 shows a cross-sectional view of a multi-row A-coil evaporator coil, the commercial embodiment this invention is designed to replace and the closest prior art of which the inventor is aware. Therein, the evaporator coil surface resistance to air flow and the angle directs the air flow. The air tends to collect at the upper section of the assembly where the two evaporator coils meet. Refrigerant circuiting as illustrated is typically vertically through the evaporator coil to take advantage of the concentration of air in the upper section of the assembly. The refrigerant tube circuits generally cross over as shown in the center section of each side of the A-coil evaporator to subject as many circuits as possible to primary air at some point along the evaporator coil and to lessen the precooling effect inherent in all multi-row evaporator coils. In contrast, applicants so called "O-coil" has, in most instances, a single row configuration with no precooling circuits and hence a higher efficiency that is unable to be obtained by this commercial prior art.

Figure 16D:
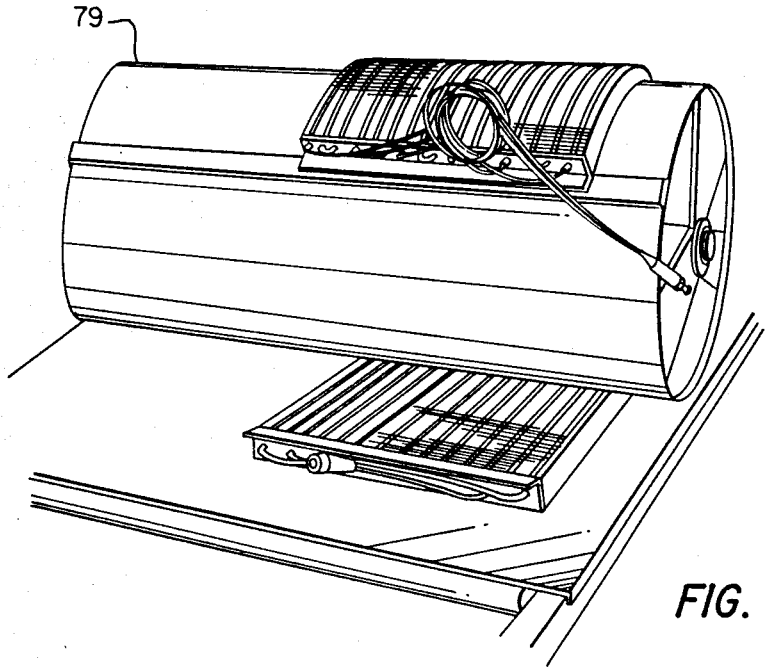
FIGS. 16*d*,-e and -f show the final steps of rotating the cylindrical drum and completing the bending of the planar coil into a cylindrical configuration.
Figure 16E:
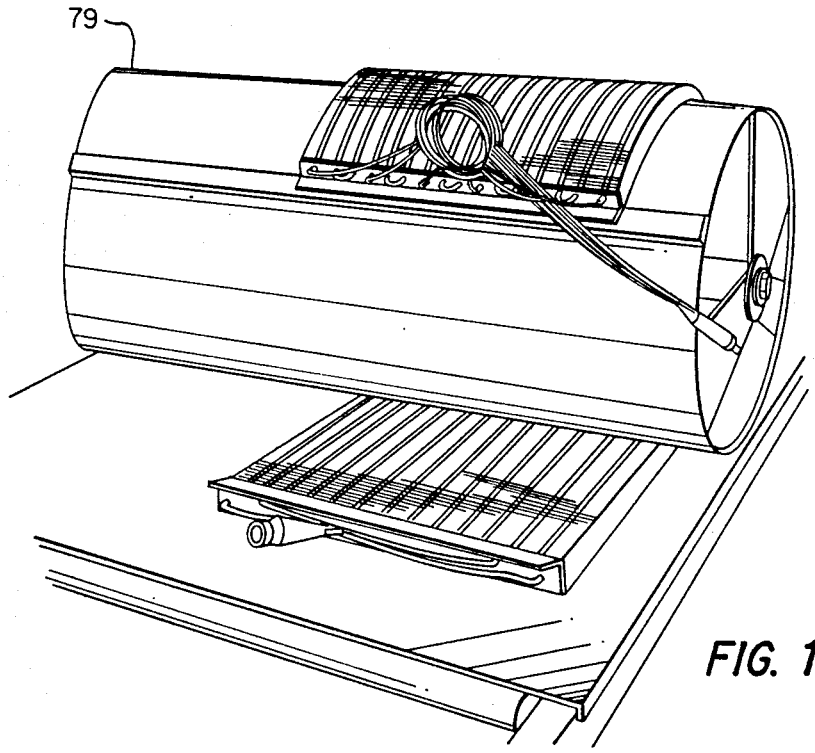
FIG. 16*a* illustrates an apparatus for bending a conventional O-Coil from a planar configuration into a right circular cylinder for installation in a small space.
FIG. 16*b* shows the progression of the bending operation a little further.
FIG. 16*c* shows an isometric view of still further bending of the configuration of FIG. 16*a*.
Figure 16F:
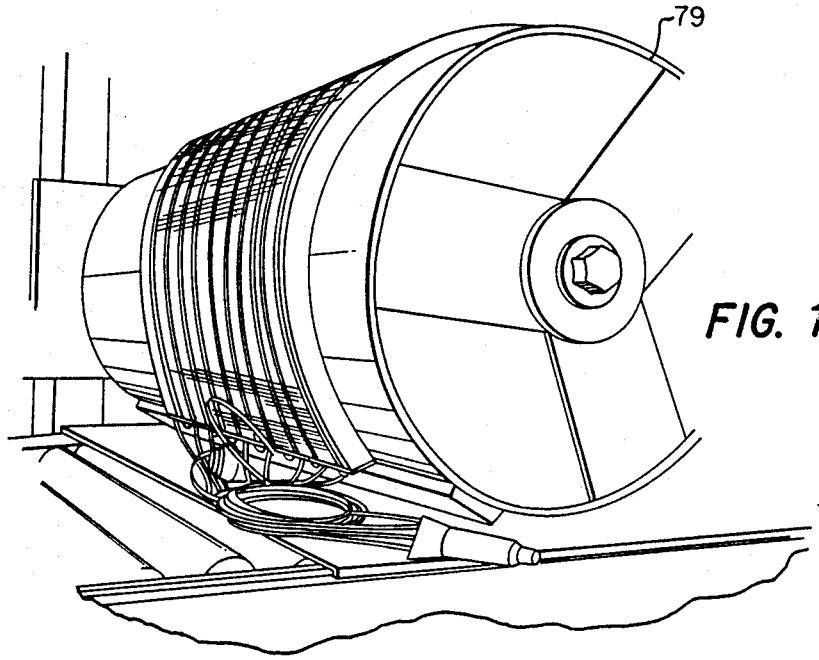
Figure 17:
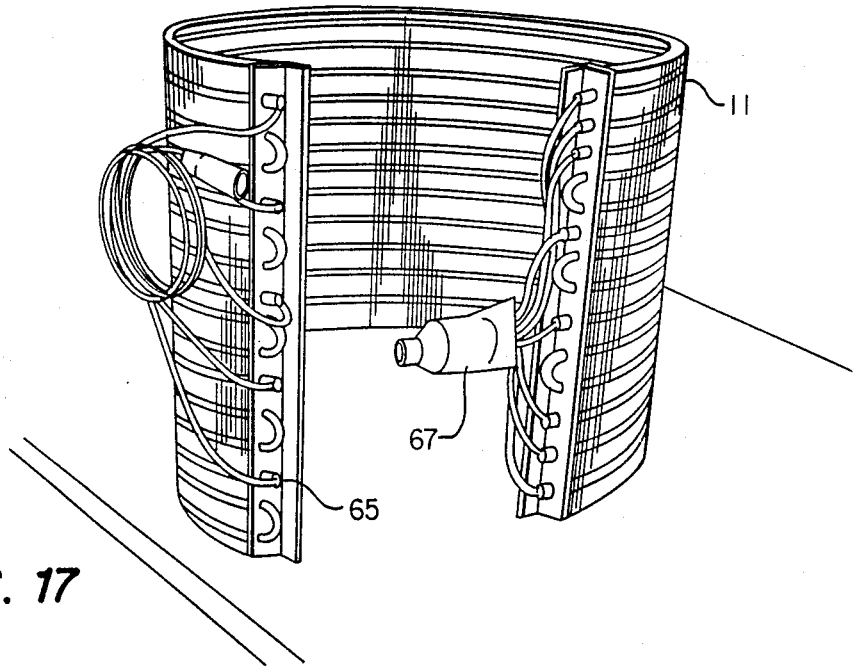
FIG. 17 shows a final cylindrical configuration of the coil with the headers attached for inlet and outlet flow of refrigerant.

Referring to FIGS. 16*a–f*, the entering refrigerant tubing 65, FIG. 16*c*, may have capillaries therewithin or other expansion devices. The leaving refrigerant tubing, or effluent header, 67, FIG. 16*e*, can also be attached and the attachment of the headers pressure checked to satisfy Underwriters Laboratories in a conventional pressure check test in which the unit is inserted under water and tested as with a pneumatic fluid. As can be seen in FIG. 17, the entering refrigerant tubing 65 and the leaving or effluent, refrigerant header 67 can be affixed and pressure tested in a single operation without requiring assembly of halves as in the A-coil.

As can be seen in the finished arcuate evaporator coil of FIG. 17, the coil 11 can be inserted into the coil enclosure but cannot move the air. It has no fan or air mover. It is designed to be used with a readily available residential or light commercial furnace or air handler. It can be employed with air entering the top or the bottom and as indicated with respect to the embodiment of FIG. 14, achieving substantially uniform heat transfer between the heat transfer fluid in the heat exchange fluid circuit and the air flowing over the tubing and fins of the evaporator coil. The evaporator coil comprises usually a single row of tubing and, hence, has a very low pressure drop thereacross. It can be employed with a change of state as for refrigerant and it is in this embodiment that it is most useful. Since the evaporator coil is designed to be used in residential application, the evaporator assembly should be designed to fit within a 2'0" (two foot) wide doors that are often encountered. This design allows for evaporator assembly installation without disassembly of the door or door facing. The O-coil assembly is designed to replace a conventional A-coil assembly in either replacement or new construction applications and work in unison with a conventional furnace or air handler.

The relative merits between the commercially viable A-coil evaporator employed heretofore and the O-coil evaporator of this invention have been set forth in a variety of places herein. To facilitate comparison, the following Table I shows how the relative features of each can be compared directly. A-coil evaporators (A) and (B) are typical of the A-coil evaporators used in todays marketplace. Both A-coil evaporators are of a cost effective design when compared to other A-coil evaporators in use today. As is noted in Table I, A-coil evaporator A is designed and constructed using the state of the art technology, more specifically rifled copper tubing and enhanced aluminum plate fin. A-coil B is designed and constructed using smooth copper tubing and rippled aluminum plate fin which is (and has been for many years) widely used in todays marketplace.

It will be noted that the face area of the O-coil is about 41% greater than either the A-coil"A" or the A-coil"B" having the same capacity. A glance at Table I shows that the A-coils "A" and "B" require more copper tubing in terms of linear feet than does the O-coil. Moreover, they also employ more U-bends which create greater refrigerant pressure drop. It should be noted that because the O-coil uses less U-bends its design creates a lower refrigerant pressure drop. Accordingly, a lower number of refrigerant circuits, or smaller diameter tubing could be used, if desired, and still maintain an acceptable refrigerant pressure drop, for example 2.5 PSI. In the case of smaller diameter tubing, the tube spacing could be closer together and result in higher heat transfer from the fin surface (due to the closer spacing of the tubes in the fin surface) without exceeding the allowable air pressure drop of 0.3" H2O across the evaporator assembly. It is noteworthy that these A-coils also require a greater fin width than does the O-coil. Thus they have a greater total area in terms of square inches (sq. in.), requiring more fin material.

TABLE I

| COIL | O-COIL | A-COIL "A" | % DIFF | A-COIL "B" | % DIFF |
|---|---|---|---|---|---|
| NOMINAL CAPACITY | 3-TON | 3-TON | 0% | 3-TON | 0% |
| NUMBER OF COILS | 1 | 2 | +100% | 2 | +100% |

TABLE I-continued

| COIL | O-COIL | A-COIL "A" | % DIFF | A-COIL "B" | % DIFF |
|---|---|---|---|---|---|
| NUMBER OF ROWS/COIL | 1 | 2 | +100% | 3 | +200% |
| FACE AREA SQ. FT. | 5.8 | 4.1 | −41% | 4.1 | −41% |
| TUBE DIAMETER | ⅜" | 5/16" | −20% | 5/16" | −20% |
| COPPER TUBING LINEAR FT. | 69.7 | 99 | +42% | 148.5 | +113% |
| U-BEND TUBING | 6 | 30 | +400% | 54 | +800% |
| CROSS OVER TUBING | 2 | 4 | +100% | 6 | +200% |
| FIN WIDTH/COIL | .866" | 1.25" | +44% | 1.825" | +116% |
| PLATE FIN TOTAL AREA SQ. IN. | 725 | 742 | +2.4% | 1114 | +53% |
| COPPER TUBE TREATMENT | Rifled | Rifled | | Smooth | |
| FACE VELOCITY/SQ FT AT 1200 CFM | 206 | 293 | +42% | 293 | +42% |
| AIR PRESSURE DROP ACROSS COIL (wet) AT 1200 CFM | 0.09" H2O | .113" H2O | +25% | .117" H2O | +30% |

C.F.M. = Cubic Feet Per Minute
Note:
Air pressure drop data in the comparisons is the pressure drop across the total coil surface in the flat and does not include the pressure drop across the coil assembly.

The percentage difference columns listed beside A-Coil "A" and A-Coil "B" pertains to the percentage difference of that particular coil item when compared against the O-coil of the first column.

The performance for all three coils in terms of capacity and efficiency is approximately the same. All three coils would consume approximately the same area in application. For example, an evaporator coil enclosure with the dimension of 21"W×21"D×18"H could be used with any of the three coils.

In addition, the A-coil evaporators have a higher face velocity at 1200 cubic feet per minute than does the O-coil and their air pressure drop across the coil (wet) is somewhat greater. It is particularly worth noting that the A-coils have inclined sides, or slabs and end plates because the air has to flow through the coil; and the inclined sides do not drain condensate from the coils as readily as does the vertical configuration of the O-coil. It should be noted that the end result of the slower drainage off the inclined A-coil slabs is water bridging that tends to have an insulating effect on the evaporator's fins and results in a loss of heat transfer. Other savings points have been noted hereinbefore.

Additional information includes the following:

The design includes the coil enclosure as an integral part of the assembly as described hereinbefore with respect to FIG. 12*a*. To achieve the directional characteristics, it is desired for a rectangular coil housing Ap to have at least 1.35 times the total area of the coil, Ac at an air flow rate no greater than 37.5 cfm (cubic feet per minute) per 1000 BTU's (British Thermal Units). A round or oval evaporator housing should have an area of at least 1.2 times the area of the coil at an air flow rate no greater than 37.5 cfm per 1000 BTU's. The coil housing can be provided in part or entirely with the assembly or can be constructed in the field as long as the minimum dimensions are observed. The O-coil assembly of this invention, can replace any of the prior art patents; whereas, the prior art patented apparatus cannot be installed to take the place of the O-coil of this invention. The O-coil of this invention preferably incorporates rifled tubing and enhanced plate fins and this technology increases the heat transfer approximately 25 percent compared to the prior art, Present designs of the present invention provides 40 percent more surface area within commercially acceptable housing size than conventional coil or coils of the prior art. In addition, the present invention is designed to operate at air flow volumes, (350 to 450 cubic feet per minute per ton of heat transfer capacity) normally encountered in residential and light commercial air conditioning, without exceeding the maximum static pressure allowance, (0.3" H2O) for evaporator assemblies, designed into standard residential and light commercial furnaces and air handlers.

Due to the large surface area in the one row configuration of the majority of the embodiments of this evaporator coil, the air flow velocity per unit area through the coil is much lower than conventional evaporators and will be generally in the range of 200 feet per minute across a square foot of the face. The large surface area and low face velocity allows for humidity removal equal to a conventional evaporator in direct replacement situations. Also, the large face area, low velocity and one row construction results in a low pressure drop across the assembly; for example, satisfying ARI 210-81 standard and DOE's regulations with no more than 0.3" water pressure drop.

In this invention pressure drop is reduced so a smaller air handler can be employed. A smaller motor generates less heat and saves in this respect also.

The cost savings of this coil are substantial and material savings can run up to approximately 40 percent differential, not including labor savings. Many ways of bending a planar coil into the desired arcuate shape will come to the mind of the expert. To form a right circular cylinder, it is easy to use a drum for bending the planar coil. The planar coil 11 is simply emplaced beneath the drum 79 and on rollers 81, FIG. 16*a*. Thereafter, the end of the coil 11 is affixed to the drum 79 and the drum is rotated. The end can be affixed by a bar that is operated by a pneumatic, hydraulic, or combination system to press tightly against the planar coil without deforming the tubing or fins. The coil may have the respective refrigerant inlet tubing and effluent tubing in place and pressure tested if desired. The final connection into a heat exchange fluid circuit can be checked for leaks in a conventional way. In any event, the unit 11 is bent into the final form, illustrated in FIG. 17.

Figure 18B:
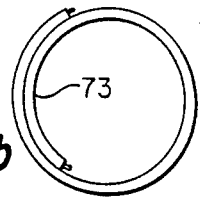
FIG. 18*b* is a top view of the scrolled O-coil of FIG. 18*a* after it is overlapped a certain portion.

As can be seen with regard to FIGS. 18*a* and 18*b*, a planar heat exchanger can be bent into a configuration with an overlap 73. The overlapping portion 73, FIG. 18*b*, can provide additional capacity if there is a slight increase desired. The tradeoff will be a diminishing in the efficiency since the overlapping portion will have some of the disadvantages of the prior art multi-row evaporators. Consequently, this O-coil invention is not operating at its best if employed with an overlap 73 such as illustrated in FIGS. 18*a* and 18*b*.

Figure 19A:
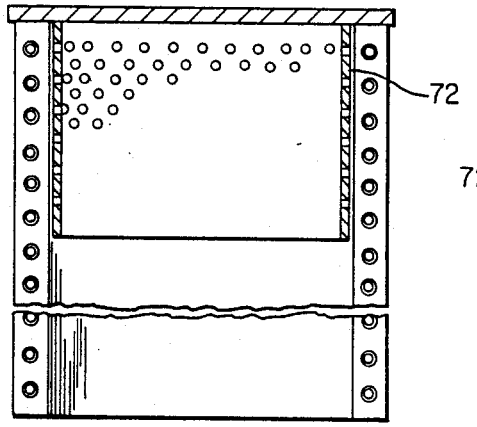
FIG. 19*a* shows an O-coil side elevational view in which an interiorly mounted foraminous screen is employed for affecting the flow of air.
Figure 19B:
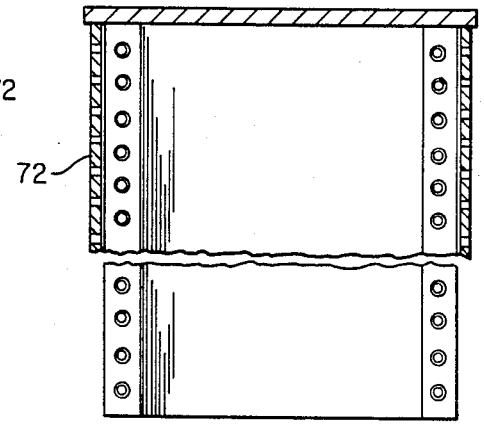
FIG. 19*b* is a partial side elevational view of the O-coil arrangement with a foraminous screen outside the O-coil to affect the flow of air.
Figure 21A:
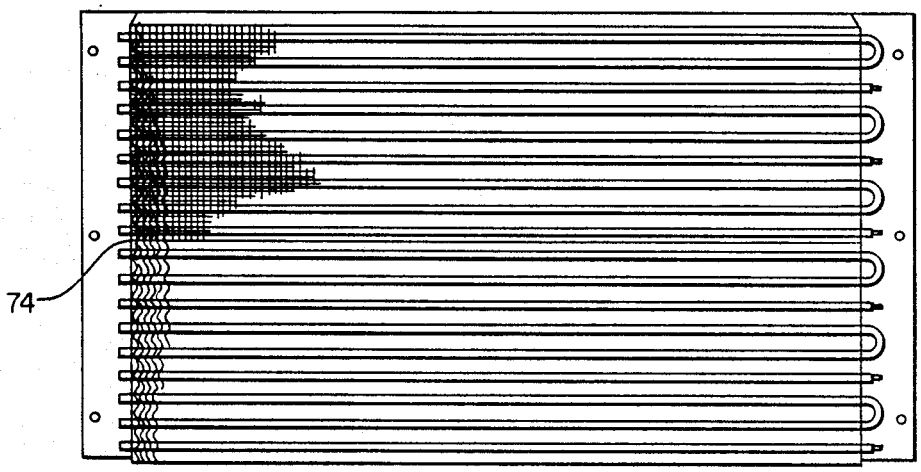
FIG. 21*a* is a front elevational view of a coil in flat before forming and having a screen wire or the like to restrict air flow covering at least a portion of the fins.

As noted hereinbefore, the O-coils may have supplemental means to affect the flow of air. The critical ratios of the areas of the housing to affect the flow of air has been discussed hereinbefore. It is noteworthy that a screen such as the foraminous screens 72 of FIGS. 19*a* and 19*b*, or the screen wire 74 of FIG. 21*a* can be emplaced either inside or outside of the unit to affect the flow of air if desired. This is an economical way to affect the flow of air.

Figure 20A:
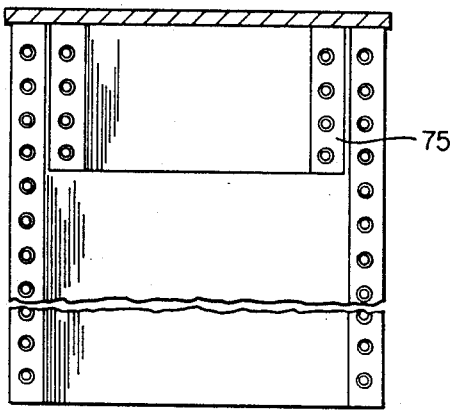
FIG. 20*a* shows a partial cross-section arrangement of an O-coil in which a partial coil is employed interiorly of the O-coil to affect flow of air.
Figure 20B:
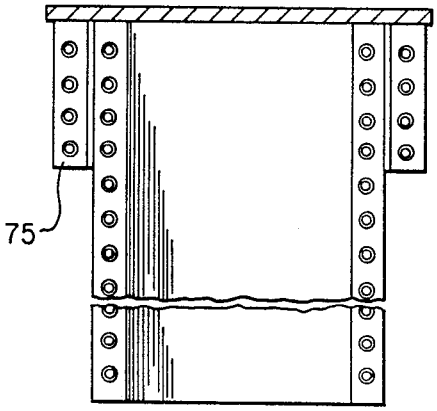
FIG. 20*b* is a partial cross-sectional view showing one side of an O-coil having an exteriorly arranged partial coil for affecting flow of air through the coil.
Figure 23:
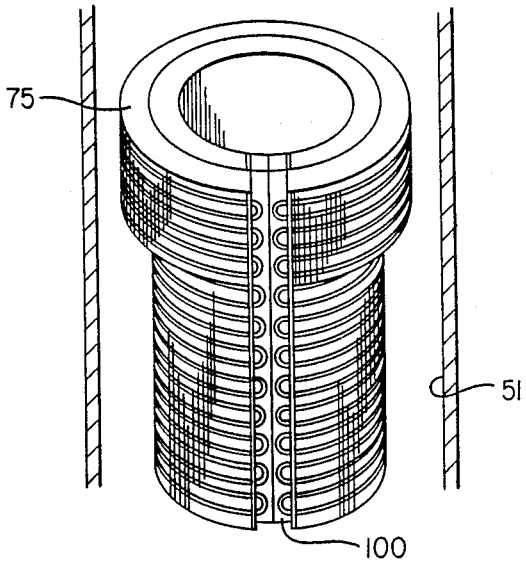
FIG. 23 is an isometric view of a coil similar to that of FIG. 22 in which the partial coil is formed around the top of the conventional O-coil, with the coil enclosure sides illustrated by straight lines.

It should be born in mind, also, that this invention can be improved somewhat and the flow of air affected by the provision of a partial coil, such as illustrated by the numeral 75, FIGS. 20*a*, 20*b*, and 23.

The partial coil simply adds capacity in the ordinary instance. It can be employed, however, as a means for affecting the flow of air, it will cause a larger portion of the air to flow through the single row portion of the coil remote from the extra partial row placement. This is particularly true where the primary O-coil is a single row coil that has been bent into the arcuate configuration but has a slightly low capacity as compared with that desired. Expressed otherwise, the supplemental coil 75 can add somewhat to the capacity of the unit, similarly as described hereinbefore with respect to the overlapping of the coil. Thus, the use of a supplemental coil can affect the flow of air and can also be employed to add a slight measure of capacity, even though it may suffer somewhat from the defect of the prior art by having a precooling of a section of the tubing.

Figure 21B:
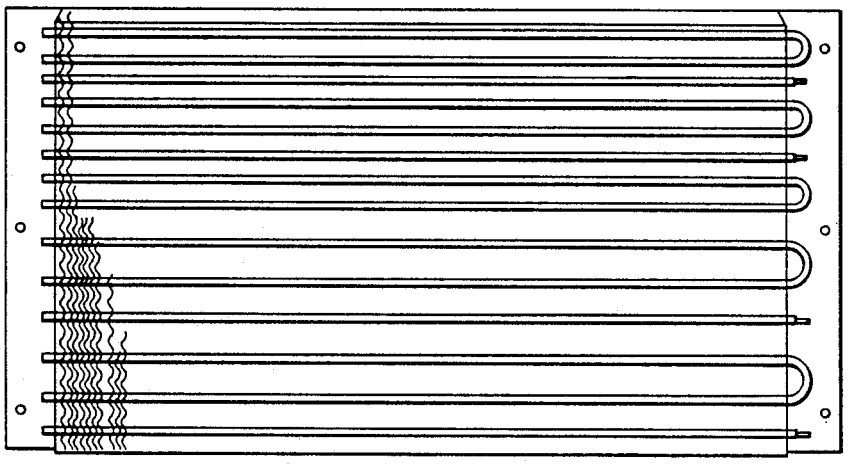
FIG. 21*b* is a front elevation view of a coil in the flat before forming and having change in tube spacing to restrict air flow covering at least a portion of the fins.
Figure 21C:
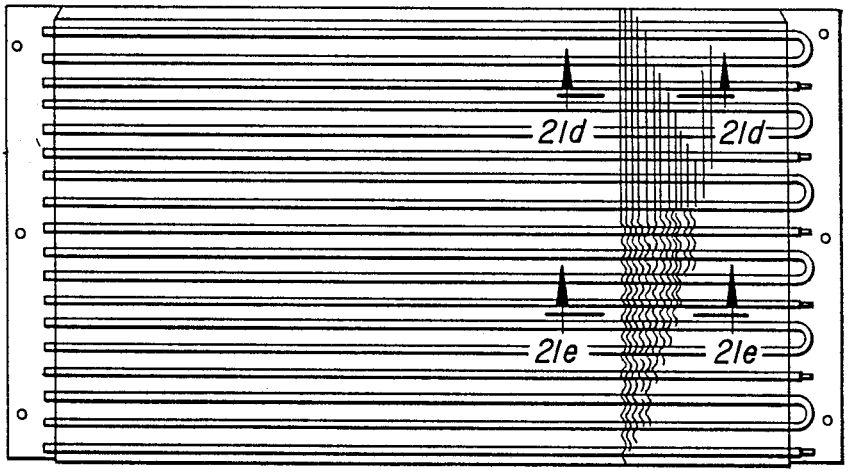
FIG. 21*c* is a front elevation view of a coil in the flat before forming and having a change in fin form to restrict air flow over at least a portion of the fins.
Figure 21D:
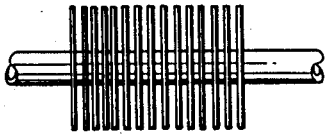
FIG. 21*d* is a blown up section showing a kind of plain fin form per 21*d* of FIG. 21*c*.
Figure 21E:
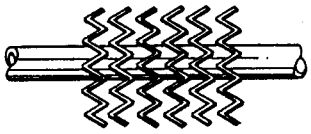
FIG. 21*e* is a blown up section showing a different kind of fin form per 21*e* of FIG. 21*c*.
Figure 22:
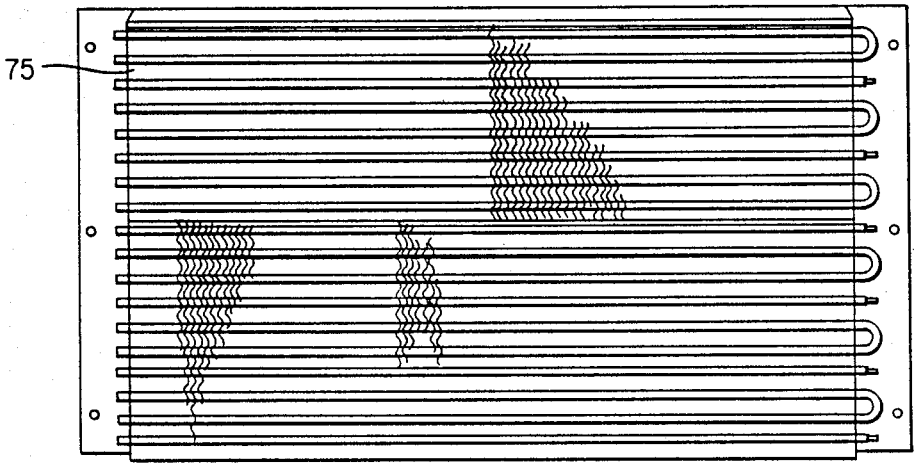
FIG. 22 is a view in flat before forming with an extra coil in place and serving as a partial coil for affecting the flow of air.

Another means of affecting the airflow that could be employed is a change in fin form and/or fin width as depicted in FIG. 21*c*, 21*d*, and 21*e* with the change occurring vertically in the fin and affect in a horizontal section of the evaporator by either reducing the passageway for air flow and/or increasing the air resistance of a horizontal portion of the coil, thereby affecting the flow of air; for example, reducing the flow rate of air through the top portion of the coil in an upflow configuration and causing a greater portion of the air to flow through the bottom section of the coil 11.

Still another means of affecting the flow of air through the evaporator assembly could be a change in the spacing of the refrigerant tubes as depicted in FIG. 21*b*, for example from 1.25" center to center in the bottom portion of the evaporator to 1.0" center to center in the upper section of the evaporator. Where the change in spacing occurs vertically in the evaporator, it affects a horizontal section of the evaporator so as to reduce the passageway for airflow and increases airflow resistance in that portion of the evaporator where the closer spacing takes place.

It is noted that the airflow means affecting the distribution of radial air flow through the evaporator assembly (such as the foraminous screen, the screen wire, the extra partial row, the change in fin form and/or pattern, or the change in tube spacing) should be positioned relative to the coil. Thus in an upflow embodiment of FIG. 7 where the deflector 41 might cause a higher pressure concentration near the top of the evaporator coil, the means for affecting air flow described herebefore should be located near the top of the evaporator as depicted in FIGS. 19*a*, 19*b*, 20*a*, 20*b*, 21*a*, 21*b*, and 21*c*. The means for affecting air flow is particularly helpful where the housing 51 is positioned relatively close to the outer surface to the O-coil evaporator.

In operation, the planar coil is bent into the desired shape, with or without the headers attached. With headers attached, the coil is emplaced inside of the enclosure 51, FIG. 12*a*. A filler plate 100, FIG. 23 blocks the flow of air through the space of the headers and return bends. After the evaporator coil is bent into the desired arcuate shape, it is emplaced within a section of the plenum, or evaporator enclosure. Specifically, the evaporator enclosure can be installed about the coil. The enclosure 51 with the evaporator interiorly thereof, can be installed in new plenum or as a replacement in a retrofit situation. The copper tubing on the inlet side of the coil is connected with the heat exchange fluid circuit for circulating of the heat exchange fluid therethrough. Thereafter, the air can be flowed past the evaporator coil (tube and fins) to obtain the desired heat transfer for cooling the air being flowed therepast. The direction of airflow can be in either direction.

It must be readily apparent, however, that though the evaporator embodiment is illustrated and described herein, since it is the most complicated and involves a change of state of the heat exchange fluid, other embodiments can be employed if desired.

One of the advantages of this invention is that it can be installed for either upflow or downflow situation with respect to the air flow.

Another advantage of this invention is that it can be employed with its arcuate coil being designed, or adapted, to remove moisture from the indoor air. In such an event, a humidistat can be employed to achieve a desired comfort index by effecting control of humidity; and a drain pan is employed to catch and drain off liquid water and transfer the condensate out of the conditioned area through suitable drain piping.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. In an improved compact evaporator assembly, also referred to herein as an air cooling and dehumidifying assembly, adapted for use in an indoor air conditioning system comprising an air duct system having a central trunk and multiple branch ducts for, respectively, distributing and returning air; a furnace including a blower for moving room air through the duct system; a plenum chamber, referred to as a coil enclosure, of limited length in the axial flow direction forming at least a part of the central trunk of the duct system and being located adjacent the furnace and intermediate the distributing and returning ducts; an evaporator assembly in the plenum chamber; and an air conditioner pump and condenser physically distinct and separated from the air cooling and dehumidifying assembly and connected thereto by refrigerant circuits, the improvement comprising said air conditioning and dehumidifying assembly having an evaporator coil of arcuate shape formed by bending about a central axis a fin and tube heat exchanger core of planar shape having about one row of tubing longitudinally of said coil, said cooling and dehumidifying assembly furthermore having an air directing means located at one end of said evaporator coil and including a central passageway permitting passage of the room air along the central axis of the coil to or from the interior of said evaporator assembly coil in either direction, and said air directing means cooperating with said plenum chamber, or coil enclosure, to assure that all the air passing through said plenum chamber, or coil enclosure, passes through the interior of said evaporator coil and an air deflector means at the other end of said coil for converting the flow of air to radial components for passing through said arcuate shaped evaporator coil and into the central trunk of said multiple branch duct system, with an air pressure drop across said evaporator assembly of no more than 0.3" water; said plenum chamber, or coil enclosure, having a volume that is at least 1.2 times as great as the volume of the coil enclosure such that if the height of the coil enclosure and the plenum chamber are the same, the area of the plenum chamber Ap equal at least 1.2 times Ac, the area of the coil.

2. The improved compact evaporator assembly of claim 1 wherein there is provided an airflow distribution means for affecting the distribution of radial airflow through said evaporator coil and said airflow distribution means comprises a screen wire located adjacent said evaporator coil so as to affect flow of air through a horizontal section of said evaporator coil.

3. The improved evaporator assembly of claim 2 wherein said screen wire is located inside said evaporator coil.

4. The improved evaporator assembly of claim 2 wherein said screen wire is located outside said evaporator coil.

5. The evaporator assembly of claim 1 wherein there is provided an airflow distribution means for affecting the distribution of radial airflow through said evaporator coil and said airflow distribution means comprises a foraminous screen located adjacent said evaporator coil so as to affect the flow of air through a horizontal section of said evaporator coil.

6. The improved evaporator assembly of claim 5 wherein said foraminous screen is located inside said evaporator coil.

7. The improved evaporator assembly of claim 5 wherein said foraminous screen is located outside said evaporator coil.

8. The evaporator assembly of claim 1 wherein there is provided an airflow distribution means for affecting the distribution of radial airflow through said evaporator coil and said airflow distribution means comprises a change in tube spacing, said change in tube spacing occurring longitudinally of said coil and affecting a longitudinal section of the evaporator coil.

9. The evaporator assembly of claim 1 wherein there is provided an airflow distribution means for affecting the distribution radial airflow through said evaporator coil and said airflow distribution means comprises a change in fin width, said change in fin width occurring longitudinally of said coil and affecting a longitudinal section of the evaporator coil.

10. The evaporator assembly of claim 1 wherein said evaporator coil has a section that is overlapped with one end of said coil lying interiorly of the other end of said coil.

11. The evaporator assembly of claim 1 wherein said evaporator coil has inlet and effluent refrigerant manifold means both on one end and the other end of said evaporator coil has return bends.

12. The evaporator assembly of claim 1 wherein said plenum chamber is substantially rectangular shaped with at least a plurality of 90 degree angles and wherein the area of said coil is circular in cross-section and wherein Ap, the area of the plenum is equal to at least 1.35 times Ac, the area of the coil.

13. The evaporator assembly of claim 1 wherein said air conditioner pump and condenser is a reverse cycle heat pump unit and when said evaporator assembly is used in combination with said reverse cycle heat pump it is an indoor evaporator during the cooling cycle and an indoor condenser during the heating cycle.

14. In an improved compact evaporator assembly also referred to herein as an air cooling dehumidifying assembly, adapted for use in an indoor air conditioning system comprising an air duct system having a central trunk and multiple branch ducts for, respectively, distributing and returning air; a furnace including a blower for moving room air through the duct system; a plenum chamber, referred to as a coil enclosure also, of limited length in the axial flow direction forming at least a part of the central trunk of the duct system and being located adjacent the furnace and intermediate the distributing and returning ducts; an evaporator assembly in the plenum chamber; and an air conditioner pump and condenser physically distinct and separated from the air cooling dehumidifying assembly and connected thereto by a refrigerant circuits, the improvement comprising said air conditioning and dehumidifying assembly having an evaporator coil of arcuate shape formed by bending about a central axis a fin and tube heat exchanger core of planar shape having no more than one complete tube row plus one additional partial row of tubes, said evaporator assembly furthermore having an air directing means located at one end of said evaporator coil and including a central passageway permitting passage of the room air along the central axis of the coil to or from the interior said air cooling and dehumidifying assembly coil, said air directing means cooperating with said plenum chamber, or coil enclosure, to assure that all the air passing through said plenum chamber, or coil enclosure, passes through the interior of said evaporator coil and an air deflector means at the other end of said coil for converting the flow of air to radial components for passing through said arcuate shaped evaporator coil and into the central trunk of said multiple branch duct system, with an air pressure drop across said evaporator assembly of no more than 0.3" water, said plenum chamber having an area Ap at least 1.2 times Ac, the area of the coil.

15. The evaporator assembly of claim 14 wherein there is provided an airflow distribution means for affecting the distribution of radial airflow through said evaporator coil and said airflow distribution means comprises a screen wire located adjacent said evaporator coil and affecting a longitudinal section of the evaporator coil.

16. The evaporator assembly of claim 15 wherein said screen wire is inside said evaporator coil.

17. The evaporator assembly of claim 15 wherein said screen wire is outside said evaporator coil.

18. The evaporator assembly of claim 14 wherein there is provided an airflow distribution means for affecting the distribution of radial airflow through said evaporator coil and said airflow distribution means comprises a foraminous screen located adjacent said evaporator coil and affecting a longitudinal section of the evaporator coil.

19. The evaporator assembly of claim 18 wherein said foraminous screen is located inside said evaporator coil.

20. The evaporator assembly of claim 18 wherein said foraminous screen is located outside said evaporator coil.

21. The evaporator assembly of claim 14 wherein there is provided an airflow distribution means for affecting the distribution of radial airflow through said evaporator coil and said airflow distribution means comprises a change in tube spacing, said change in tube spacing occurring longitudinally of said coil and affecting a longitudinal section of the evaporator coil.

22. The evaporator assembly of claim 14 wherein there is provided an airflow distribution means for affecting the distribution of radial airflow through said evaporator coil and said airflow distribution means comprises a change of fin width, said change in fin width occurring longitudinally of said coil and affecting a longitudinal section of the evaporator coil.

23. The evaporator assembly of claim 14 wherein said evaporator coil has inlet and effluent refrigerant manifold means both on one end and the other end of said evaporator coil has return bends.

24. The evaporator assembly of claim 14 wherein said air conditioner pump and condenser is a reverse cycle heat pump unit and when said evaporator assembly is used in combination with said reverse cycle heat pump it is an indoor evaporator during the cooling cycle and an indoor condenser during the heating cycle.

25. The evaporator assembly of claim 14 wherein said plenum chamber is substantially rectangular in cross-sectional shape with a plurality of 90 degree angles; wherein said coil is substantially circular and cross-sectional area after being bent in said arcuate shape; wherein said area Ap, the area of the plenum chamber is at least 1.35 times Ac, the area of the coil.

26. In an improved compact evaporator assembly also referred to herein as an air cooling and dehumidifying assembly, adapted for use in an indoor air conditioning system comprising an air duct system having a central trunk and multiple branch ducts, for, respectively, distributing and returning air; a furnace including a blower for moving room air through the duct system; a plenum chamber, referred to as a coil enclosure also, of limited length in the axial flow direction forming at least a part of the central trunk of the duct system and being located adjacent the furnace and intermediate the distributing and returning ducts; an evaporator assembly in the plenum chamber; and an air conditioner pump and condenser physically distinct and separated from the air cooling and dehumidifying assembly and connected thereto by refrigerant circuits, the improvement comprising said air conditioning and dehumidifying assembly having an evaporator coil of arcuate shape formed by bending about a central axis a fin and tube heat exchanger core of planar shape having no more than two complete tube rows, said evaporator assembly furthermore having an air directing means located at one end of said evaporator coil and including a central passageway permitting passage of the room air along the central axis of the coil to or from the interior of said evaporator assembly coil and said air directing means cooperating with said plenum chamber or coil enclosure to assure that all the air passing through said plenum chamber or coil enclosure passes through the interior of said evaporator coil and an air deflector means at the other end of said coil for converting the flow of air to radial components for passing through said arcuate shaped evaporator coil and into the central trunk of said multiple branch duct system, with an air pressure drop across said evaporator assembly of no more than 0.3" water; said plenum chamber having an area Ap at least 1.2 times Ac, the area of the coil.

27. The evaporator assembly of claim 26 wherein there is provided an airflow distribution means for affecting the distribution of radial airflow through said evaporator coil and said airflow distribution means comprises a screen wire located adjacent said evaporator coil and affecting a longitudinal section of the evaporator coil.

28. The evaporator assembly of claim 27 wherein said screen wire is inside said evaporator coil.

29. The evaporator assembly of claim 27 wherein said screen wire is outside said evaporator coil.

30. The evaporator assembly of claim 26 wherein there is provided an airflow distribution means for affecting the distribution of radial airflow through said evaporator coil and said airflow distribution means comprises a foraminous screen located adjacent said evaporator coil and affecting a longitudinal section of the evaporator coil.

31. The evaporator assembly of claim 30 wherein said foraminous screen is inside said evaporator coil.

32. The evaporator assembly of claim 30 wherein said foraminous screen is outside said evaporator coil.

33. The evaporator assembly of claim 26 wherein there is provided an airflow distribution means for affecting the distribution of radial airflow through said evaporator coil and said airflow distribution means comprises a change in tube spacing, said change in tube spacing occurring longitudinally of the coil and affecting a longitudinal section of the evaporator coil.

34. The evaporator assembly of claim 26 wherein there is provided an airflow distribution means for affecting the distribution of radial airflow through said evaporator coil and said airflow distribution means comprises a change in fin width, said change in fin width occurring longitudinally of said coil and affecting a longitudinal section of the evaporator coil.

35. The evaporator assembly of claim 26 wherein said evaporator coil has inlet and effluent refrigerant manifold means both on one end and the other end of said evaporator coil has return bends.

36. The evaporator assembly of claim 26 wherein said air conditioner pump and condenser is a reverse cycle heat pump unit and when said evaporator assembly is used in combination with said reverse cycle heat pump it is an indoor evaporator during the cooling cycle and an indoor condenser during the heating cycle.

37. In an improved compact evaporator assembly also referred to herein as an air cooling and dehumidifying assembly, adapted for use in an indoor air conditioning system comprising an air duct system having a central trunk and multiple branch ducts for, respectively distributing and returning air; a furnace including a blower for moving air through the duct system; a plenum chamber, referred to as a coil enclosure also, of limited length in the axial flow direction forming at least a part of the central trunk of the duct system and being located adjacent the furnace and intermediate the distributing and returning ducts; and the evaporator assembly in the plenum chamber; and an air conditioner pump and condenser physically distinct and separated from the air cooling and dehumidifying assembly and connected thereto by refrigerant circuits, the improvement comprising said air conditioning and dehumidifying assembly having an evaporator coil of arcuate shape formed by bending about a central axis a fin and tube heat exchanger core of planar shape having about one tube row, said evaporator assembly furthermore having an air directing means located at one end of said evaporator coil and including a central passageway for admitting passage of the room air along a central axis of the coil to or from the interior of said evaporator assembly coil and said air directing means cooperating with said plenum chamber, or coil enclosure, to assure that all the air passing through said plenum chamber, or coil enclosure, passes through the interior of said evaporator coil and an air deflector means at the other end of said coil for converting the flow of air to radial components for passing through said arcuate shaped evaporator coil and into the central trunk of said multiple branch duct system, with an air pressure drop across the evaporator assembly of no more than 0.3" water and wherein there is provided an airflow distribution means affecting the distribution of radial flow through said evaporator coil and said airflow distribution means comprising a change in fin form, said change in fin form occurring vertically of the fin and affecting a longitudinal section of the evaporator coil; said plenum chamber having a cross-sectional area Ap at least 1.2 times Ac, the area of the evaporator assembly coil.

38. The evaporator assembly of claim 37 wherein said evaporator coil has inlet and effluent refrigerant manifold means both on one end and the other end of said evaporator coil has return bends.

39. The air evaporator assembly of claim 37 wherein said air conditioner pump and condenser is a reverse cycle heat pump unit and when said evaporator assembly is used in combination with said reverse cycle heat pump it is an indoor evaporator during the cooling cycle and an indoor condenser during the heating cycle.

40. In an improved compact evaporator assembly, also referred to herein as an air cooling and dehumidifying assembly, adapted for use in an indoor air conditioning system comprising an air duct system having a central trunk and multiple branch ducts for, respectively, distributing and returning air; a furnace including a blower for moving room air through the duct system; a plenum chamber, referred to as a coil enclosure, of limited length in the axial flow direction forming at least a part of the central trunk of the duct system and being located adjacent the furnace and intermediate the distributing and returning ducts; an evaporator assembly in the plenum chamber; and an air conditioner pump and condenser physically distinct and separated from the air cooling and dehumidifying assembly and connected thereto by refrigerant circuits, the improvement comprising said air conditioning and dehumidifying assembly having an evaporator coil of arcuate shape formed by bending about a central axis a fin and tube heat exchanger core of planar shape having one row of tubing and one additional partial row longitudinally of said coil, said cooling and dehumidifying assembly furthermore having an air directing means located at one end of said evaporator coil and including a central passageway permitting passage of the room air along the central axis of the coil to or from the interior of said evaporator assembly coil in either direction, and said air directing means cooperating with said plenum chamber, or coil enclosure, to assure that all the air passing through said plenum chamber, or coil enclosure, passes through the interior said evaporator coil and an air deflector means at the other end of said coil for converting the flow of air to radial components for passing through said arcuate shaped evaporator coil and into the central trunk of said multiple branch duct system, with an air pressure drop across said evaporator assembly of no more than 0.3" water and wherein there is provided an airflow distribution means affecting the distribution of radial flow through said evaporator coil and said airflow distribution means comprises a change in fin form, said change in fin form occurring vertically of the fin and affecting a longitudinal section of the evaporator coil; said plenum chamber, or coil enclosure, having a volume that is at least 1.2 times as great as the volume of the coil enclosure such that if the height of the coil enclosure and the plenum chamber are the same, the area of the plenum chamber Ap equal at least 1.2 times Ac of the area of the coil.

41. The evaporator assembly of claim 40 wherein said evaporator coil has inlet and effluent refrigerant manifold means both on one end and the other end of said evaporator coil has return bends.

42. The evaporator assembly of claim 40 wherein said air conditioner pump and condenser is a reverse cycle heat pump unit and when said evaporator assembly is used in combination with said reverse cycle heat pump it is an indoor evaporator during the cooling cycle and an indoor condenser during the heating cycle.

43. In an improved compact evaporator assembly, also referred to herein as an air cooling and dehumidifying assembly, adapted for use in an indoor air conditioning system comprising an air duct system having a central trunk and multiple branch ducts for, respectively, distributing and returning air; a furnace including a blower for moving air through the duct system; a plenum chamber, referred to as a coil enclosure, limited length in the axial flow direction forming at least a part of the central trunk of the duct system and being located adjacent the furnace and intermediate the distributing and returning ducts; and the evaporator assembly in the plenum chamber; and an air conditioner pump and condenser physically distinct and separated from the air cooling and dehumidifying assembly and connected thereto by refrigerant circuits, the improvement comprising said air conditioning and dehumidifying assembly having an evaporator coil of arcuate shape formed by bending about a central axis a fin and tube heat exchanger core of planar shape having no more than two complete tube rows, said evaporator assembly further more having an air directing means located at end of said evaporator coil and including a central passageway permitting passage of the room air along with central axis of the coil to or from the interior of said evaporator assembly coil and said air directing means cooperating with said plenum chamber, or coil enclosure, to assure that all the air passing through said plenum chamber or coil enclosure passes through the interior of said evaporator coil and an air deflector means at the other end of said coil for converting the flow of air to radial components for passing through said arcuate shaped evaporator coil and into the central trunk of said multiple branch duct system, with an air pressure drop across the evaporator assembly of no more than 0.3" water and wherein there is provided an airflow distribution means affecting the distribution of radial flow through said evaporator coil and said airflow distribution means comprising a change in fin form, said change in fin form occurring vertically of the fin and affecting a longitudinal section of the evaporator coil; said plenum chamber having a cross-sectional area Ap at least 1.2 times Ac, the area of the evaporator assembly coil.

44. The evaporator assembly of claim 43 wherein said evaporator coil has inlet and effluent refrigerant manifold means both on one end and the other end of said evaporator coil has return bends.

45. The evaporator assembly of claim 43 wherein said air conditioner pump and condenser is a reverse cycle heat pump unit and when said evaporator assembly is used in combination with said reverse cycle heat pump it is an indoor evaporator during the cooling cycle and an indoor condenser during the heating cycle.

* * * * *